US006697041B1

(12) United States Patent
Tamai et al.

(10) Patent No.: US 6,697,041 B1
(45) Date of Patent: Feb. 24, 2004

(54) DISPLAY DRIVE DEVICE AND LIQUID CRYSTAL MODULE INCORPORATING THE SAME

(75) Inventors: Shigeki Tamai, Nara (JP); Nobuhisa Sakaguchi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/477,781

(22) Filed: Jan. 5, 2000

(30) Foreign Application Priority Data

Jan. 28, 1999 (JP) ..... 11-020737

(51) Int. Cl.[7] ..... G09G 3/36
(52) U.S. Cl. ..... 345/100; 345/98
(58) Field of Search ..... 345/100, 98

(56) References Cited

U.S. PATENT DOCUMENTS 5,351,145 A * 9/1994 Miyata et al. ..... 349/48
5,353,041 A * 10/1994 Miyamoto et al. ..... 345/97
5,489,867 A * 2/1996 Tamanoi ..... 327/269
5,642,127 A 6/1997 Tamai ..... 345/95
5,828,357 A 10/1998 Tamai et al. ..... 345/89
5,917,238 A 6/1999 Tamai ..... 257/690
5,920,221 A * 7/1999 Shen et al. ..... 327/264
6,002,384 A 12/1999 Tamai et al. ..... 345/95
6,057,866 A * 5/2000 Haneda et al. ..... 347/118
6,144,355 A * 11/2000 Murata et al. ..... 345/213
6,157,228 A * 12/2000 Yokoyama et al. ..... 327/144
6,166,715 A * 12/2000 Chang et al. ..... 345/100
6,232,939 B1 * 5/2001 Saito et al. ..... 345/100
6,236,393 B1 * 5/2001 Ogawa et al. ..... 345/211
6,256,024 B1 * 7/2001 Maekawa ..... 345/205
6,373,458 B1 * 4/2002 Yamakura et al. ..... 345/100

FOREIGN PATENT DOCUMENTS

JP A-6 3684 1/1994
JP 407104708 A * 4/1995
JP 8-022267 A 1/1996
JP 8-248926 9/1996
JP 9-138670 5/1997
JP 10124012 A * 5/1998

OTHER PUBLICATIONS

Copy of Translation of Office Action dated Jun. 10, 2003.

* cited by examiner

*Primary Examiner*—Richard Hjerpe
*Assistant Examiner*—Kevin Nguyen
(74) *Attorney, Agent, or Firm*—Birch, Stewart, Kolash & Birch LLP

(57) ABSTRACT

A display drive device of the present invention includes a plurality of cascade connected source driver LSI chips for driving a liquid crystal panel in accordance with an image data signal, and each of the source driver LSI chips includes: a shift register for shifting and transmitting a start pulse signal in synchronization with a clock signal; a sampling memory for sampling the image data signal in accordance with an output of the shift register; and a hold memory for latching a selected image data signal in accordance with a latch signal, wherein a delay circuit for generating the latch signal by delaying the start pulse signal supplied by the shift register in each of the source driver LSI chips is disposed. This arrangement enables the whole device, including a controller, etc., to be produced in a smaller size and at a lower cost.

14 Claims, 18 Drawing Sheets

5
6
CONTROLLER
R
G
B
SSPI
GSPI
GCK
FIRST SOURCE DRIVER
SECOND SOURCE DRIVER
THIRD SOURCE DRIVER
SEVENTH SOURCE DRIVER
EIGHTH SOURCE DRIVER
33
OUT
IN
3
51
SPin
SPout
LSin
4
2
GSPin
GSPout
FIRST GATE DRIVER
SECOND GATE DRIVER

DISPLAY DRIVE DEVICE AND LIQUID CRYSTAL MODULE INCORPORATING THE SAME

FIELD OF THE INVENTION

The present invention relates to a display drive device including a plurality of cascade connected drive circuits for driving a display element such as a liquid crystal display element according to an image data signal, and further relates to a liquid crystal module incorporating such a display drive device.

BACKGROUND OF THE INVENTION

A display drive device used in a conventional liquid crystal display device includes, as shown in FIG. 14, source driver LSI (Large Scale Integrated circuit) chips 51 and gate driver LSI chips 52 that are cascade connected and mounted on individual TCPs (Tape Carrier Packages) 53 to act as a plurality of drive circuits for driving a liquid crystal panel 54. Further, the display drive device, together with the liquid crystal panel 54, constitutes a liquid crystal module. Note that a TCP refers to a thin package including a tape film onto which an LSI chip is attached.

The source driver LSI chips 51 and the gate driver LSI chips 52 have output terminals electrically connected via TCP wiring on the TCPs 53 to output terminals of the TCPs 53 for output to the liquid crystal panel 54. The output terminal of the TCPs 53 to the liquid crystal panel 54 is bonded by thermocompression via, for example, an ACF (Anisotropic Conductive Film) to a terminal (not shown) fabricated from ITO (Indium Tin Oxide) on the liquid crystal panel 54 to establish electrical connection therebetween. The liquid crystal panel 54 here is supposed to have 800×3 (RGB) [source side]×600 [gate side] pixels.

Each of the source driver LSI chips 51 drives 100×3 (RGB) pixels, and performs a 64 half-tone display. Therefore, here, eight source driver LSI chips 51 are cascade connected. Hereinafter, to distinguish each of the source driver LSI chips 51 from the others, those located in first to seventh stages will be referred to as first to seventh source drivers respectively, with the source driver LSI chip 51 located in the last stage referred to as an eighth source driver.

Meanwhile, two gate driver LSI chips 52 are cascade connected here. Hereinafter, to distinguish each of the gate driver LSI chips 52 from the other, those located in first and last stages will be referred to as first and second gate drivers respectively.

The display drive device includes a flexible substrate 55 on which a controller 56 is disposed; the TCPs 53 are electrically connected to the flexible substrate 55. Specifically, the TCP wiring on the TCPs 53 that is electrically connected to the source driver LSI chips 51 and the gate driver LSI chips 52 is electrically connected via, for example, an ACF or soldering to the wiring on the flexible substrate 55 that is electrically connected to output terminals R, G, B, LS, Vcc, GND, Vref, VLS, SSPI, SCK, GCK, and GSPI (see FIG. 15) of the controller 56.

This configuration allows various signals to travel to and from the source and gate driver LSI chips 51 and 52 through the wiring on the TCPs 53 and the flexible substrate 55. The following description will explain various signal paths in the liquid crystal module.

First, the controller 56 provides, as outputs, image data signals R, G, and B at its output terminals R, G, and B, a clock signal CK at its output terminal SCK, and a latch signal LS at its output terminal LS; all these signals are then transmitted via the wiring on the flexible substrate 55 and the TCPs 53, and supplied as common signals to each of the source driver LSI chips 51.

Meanwhile, the controller 56 provides at its output terminal SSPI an output of a start pulse signal SPI which is transmitted via the wiring on the flexible substrate 55 and coupled to an input terminal SPin of the first source driver. After receiving the start pulse signal SPI, the first source driver transmits the start pulse signal SPI internally and provides an output of a start pulse signal SPO at its output terminal SPout. The output start pulse signal SPO is transmitted again via the wiring on the flexible substrate 55 and is coupled to input of a following stage, that is, an input terminal SPin of the second source driver. The start pulse signal SPI is similarly shifted and transmitted through further source drivers, until it reaches the last stage, that is, the eighth source driver.

Similarly, the controller 56 provides, as outputs, an LSI chip power supply voltage Vcc at its output terminal Vcc, 64 bit half-tone display reference voltages Vref1 to Vref6 at its output terminals Vref1 to Vref6, and a brightness adjusting voltage (voltage for adjusting the voltage applied to the liquid crystal panel 54) VLS at its output terminal VLS; all these signals, as well as a ground potential GND electrically connected to the output terminal GND of the controller 56, are supplied commonly to each of the source driver LSI chips 51. The wiring for transmitting the voltages Vcc, Vref1 to Vref6, and VLS and the ground connection line (GND line) for transmitting the ground potential GND are disposed as power supply associated lines. Hereinafter, the voltages Vcc, Vref1 to Vref6, and VLS, and the ground potential GND will be referred to as power supply associated voltages.

Meanwhile, the controller 56 provides, as outputs, a gate driver clock signal GCK at its output terminal GCK, an LSI chip power supply voltage Vcc at its output terminal Vcc, and reference voltages Vref 1 and 2 (Vref1 and Vref2) at its output terminals Vref 1 and 2 for application to the liquid crystal panel 54; all these signals, as well as a ground potential GND electrically connected to an output terminal GND of the controller 56, are supplied commonly to each of the gate driver LSI chips 52.

Further, the controller 56 provides at its output terminal GSPI an output of a gate driver start pulse signal GSPI which is coupled to an input terminal GSPin of the first gate driver. The first gate driver transmits the received start pulse signal GSPI internally in synchronization with the clock signal GCK and provides at its output terminal GSPout a start pulse signal GSPO which is coupled to an input terminal GSPin of a following stage, that is, of the second gate driver.

The following description will explain in detail a circuit arrangement of the source driver LSI chips 51 in accordance with the present invention in reference to the block diagram constituting FIG. 16 and also explain in detail operations of the source driver LSI chips 51 in reference to the signal timing charts constituting FIG. 17. Note that although the following description will deal with only one of the eight source driver LSI chips 51 shown in FIG. 14, all the source driver LSI chips 51 function completely identically.

As shown in FIG. 16, the source driver LSI chip 51 is arranged to include a shift register 61, a data latch circuit 62, a sampling memory 63, a hold memory 64, a reference voltage generator circuit 65, a D/A converter 66, and an output circuit 67.

The shift register 61 receives the start pulse signal SPI (see FIG. 17) provided as an output by the controller 56 at its output terminal SSPI and transmitted via the input terminal SPin of the source driver LSI chip 51. The start pulse signal SPI is a synchronized signal having synchronization with horizontal synchronized signals of later-mentioned image data signals R, G, and B. The shift register 61 also receives the clock signal CK (see FIG. 17) provided as an output by the controller 56 at its output terminal SCK and transmitted via the input terminal CKin of the source driver LSI chip 51.

The shift register 61 shifts the received start pulse signal SPI: more particularly, the shift register 61 starts shifting the start pulse signal SPI, with the start pulse signal SPI as a start pulse, when the clock signal CK received rises for the first time while the start pulse signal SPI is in high level.

The start pulse signal SPI shifted by the shift register 61 is provided as an outgoing start pulse signal SPO (see FIG. 17) by the source driver LSI chip 51 at its output terminal SPout, and coupled to the input terminal SPin of the following-stage source driver LSI chip 51. The start pulse signal SPI is similarly shifted by further source driver LSI chips, until it reaches the last stage source driver LSI chip 1, that is, the eighth source driver shown in FIG. 14.

Meanwhile, the image data signals R, G, and B (see FIG. 17) supplied by the controller 56 via its respective R, G, and B terminals are coupled as parallel inputs to the data latch circuit 62 via input terminals R1in to R6in, G1in to G6in, and B1in to B6in of the source driver LSI chip 51 as shown in FIG. 16. The image data signals R, G, and B are then temporarily latched by the data latch circuit 62 and transmitted to the sampling memory 63. Note that the image data signals R, G, and B are color digital image signals representing a 6-bit R (Red) set of data, a 6-bit G (Green) set of data, and a 6-bit B (Blue) set of data, collectively representing 18-bit data.

The sampling memory 63 performs sampling on the image data signals R, G, and B transmitted in a time division manner as output signals from the stages in the shift register 61, and stores the sampled signals until a later-mentioned latch signal LS (see FIG. 17) supplied by the controller 56 via its output terminal LS is received.

The hold memory 64 then receives inputs of the image data signals R, G, and B, and latches the signals at a trailing edge of the latch signal LS upon reception of a set of data for a horizontal period. The hold memory 64 holds the set of data for a horizontal period carried on the image data signals R, G, and B, until reception of a set of data for a next horizontal period from the sampling memory 63. During that period, the hold memory 64 provides the image data signals R, G, and B for output to the D/A converter 66. Here, the shift register 61 and the sampling memory 63 receive a new set of image data signals R, G, and B for a next horizontal period.

The reference voltage generator circuit 65 produces 64 levels used for a half-tone display by, for example, resisance division according to the reference voltages Vref1 to Vref6 which are provided as outputs by the controller 56 at its output terminals Vref1 to Vref6 and then coupled to the input terminals Vref1 to Vref6 of the source driver LSI chip 51.

The D/A converter 66 converts the image data signals R, G, and B, which are 6-bit R, G, and B digital image signals respectively, into analog signals. The output circuit 67 then amplifies the analog signals of 64 levels using the brightness adjusting voltage VLS which is provided as an output by the controller 56 at its output terminal VLS and then coupled to the input terminal VLS of the source driver LSI chip 51. Thereafter the output circuit 67 provides, at its output terminals XO1 to XO100, YO1 to YO100, and ZO1 to ZO100, the amplified signals which will be coupled to input terminals (not shown) of the liquid crystal panel 54.

The output terminals XO1 to XO100 constitute a terminal group of 100 terminals for the image data signals R, the output terminals YO1 to YO100 for the image data signals G, and the output terminals ZO1 to ZO100 for the image data signals B. Also, the terminals Vcc and GND of the source driver LSI chip 51 are for providing a power supply to the source driver LSI chip 51. Note that input and output buffer circuits are omitted in FIG. 16.

As mentioned so far, according to the conventional technology, a liquid crystal module is formed by cascade connecting the source driver LSI chips 51 on the TCPs 53 and supplying common and other various signals and power supply associated voltages via the flexible substrate 55, etc. to the source driver LSI chips 51.

However, recent years have seen progressively strong demand from the market for less costly and more compact liquid crystal modules. An offer to this demand is a liquid crystal module with no flexible substrate 55 to accommodate common wires, which in FIG. 14 is included, and in some cases with no print substrate that is used in place of the flexible substrate 55.

The omission of the flexible substrate 55 is made possible in the liquid crystal module by, in the arrangement shown in FIG. 14, electrically connecting adjacent TCPs 53 and employing internal wiring made of, for example, Al (aluminum) lines in the source driver LSI chips 71 (explained in detail later) to allow common signals and power supply associated voltages to be transmitted internally in the TCPs 53.

FIG. 18 shows a block diagram of a source driver LSI chip 71 used for such a liquid crystal module. Here, for convenience, members that have the same function as those shown in FIG. 14 are indicated by the same reference numerals and description thereof is omitted.

The source driver LSI chip 71 is, as shown in Figure 18, identical to the source driver LSI chip 51, except that in the source driver LSI chip 71, additional output terminals R1out to R6out, G1out to G6out, B1out to B6out, LSout, Vref1out to Vref6out, VLS, Vcc, and GND are provided to supply common signals and power supply associated voltages and also that these additional output terminals are electrically connected via internal wiring to input terminals R1in to R6in, G1in to G6in, B1in to B6in, LSin, Vref1in to Vref6in, VLS, Vcc, and GND.

The configuration allows common signals including image data signals R, G, and B and a latch signal LS, and power supply associated voltages including half-tone display reference voltages Vref1 to Vref6, a brightness adjusting voltage VLS, a power supply voltage Vcc, and a ground potential GND to be transmitted internally through the source driver LSI chip 71.

In other words, first, similarly to the arrangement shown in FIG. 14, the common signals R, G, B, and LS and the power supply associated voltages Vref1 to Vref6, VLS , Vcc and GND are fed from a controller (not shown) to the first source driver via the input terminals R1in to R6in, G1in to G6in, B1in to B6in, LSin, Vref1in to Vref6in, VLS, Vcc, and GND.

After being fed to the first source driver, the common signals R, G, B, and LS and the power supply associated voltages Vref1 to Vref6, VLS, Vcc, and GND travel via the internal wiring and appear as outputs at the output terminals R1out to R6out, G1out to G6out, B1out to B6out, LSout, Vref1out to Vref6out, VLS, Vcc, and GND of the first source driver. The common signals R, G, B, and LS and the power supply associated voltages Vref1 to Vref6, VLS, Vcc, and GND supplied by the first source driver are transmitted over electrical connections between adjacent TCPs 53 to be coupled to input terminals R1in to R6in, G1in to G6in, B1in to B6in, LSin, Vref1in to Vref6in, VLS, Vcc, and GND of a following stage, that is, of a second source driver.

Then, similarly to the foregoing, the common signals R, G, B, and LS and the power supply associated voltages Vref1 to Vref 6, VLS, Vcc, and GND are coupled to the input terminals R1in to R6in, G1in to G6in, B1in to B6in, LSin, Vref1in to Vref6in, VLS, Vcc, and GND of the third to eighth source drivers as the signals are transmitted sequentially from the second source driver to the eighth source driver, that is, the last source driver.

The components in the source driver LSI chip 71 operate in the same manner as those in the source driver LSI chip 51: for example, the source driver start pulse signal SPI is coupled as an input to the input terminal Spin, and shifted by the internal shift register 61 in synchronization with a clock signal CK to provide an output of a start pulse signal SPO at the output terminal Spout.

As shown schematically in FIG. 18, in the source driver LSI chip 71, the output terminals XO1 to XO100, YO1 to YO100, and ZO1 to ZO100 to the liquid crystal panel 54 are disposed along a side, whereas the input terminals Spin, CKin, R1in to R6in, G1in to G6in, B1in to B6in, LSin, Vref1in to Vref6in, VLSin, Vcc, and GND are disposed along one of the two sides crossing that side, and the output terminals SPout, CKout, R1out to R6out, G1out to G6out, B1out to B6out, LSout, Vref1out to Vref6out, VLS, Vcc, and GND are disposed along the other of the two sides. Here, input and output buffer circuits are omitted in FIG. 18.

FIG. 19 illustrates, as an example, an arrangement of a liquid crystal module on which the source driver LSI chips 71 are mounted. The members other than the source driver LSI chips 71 and the liquid crystal panel 54 are all omitted from the illustration.

The TCP wiring 53*a* of adjacent TCPs 53 is electrically connected with each other via source driver connection wiring 54*d* on the liquid crystal panel 54 so that the TCP wiring 53*a* disposed on the flanks of the TCPs 53 on which the source driver LSI chips 71 are mounted is electrically connected with each other. The "flanks" refer to those when the liquid crystal panel 54 is viewed in the front.

This electrical connection is achieved by disposing the source driver connection wiring 54*d* made of ITO, the same material as the pixel terminals are made of, on a liquid crystal glass substrate 54*a*, which is a lower glass of the liquid crystal panel 54, and bonding the TCPs 53 onto the liquid crystal glass substrate 54*a* via an ACF by thermo-compression simultaneously with the establishment of the aforementioned connection between the TCP wiring 53*a* on the TCPs 53 and the terminals on the liquid crystal panel 54.

In the liquid crystal module, a controller (not shown) is mounted to another flexible substrate so as to be electrically connected to source driver connection wiring 4*d* on the liquid crystal panel 54.

Note that the TCP wiring 53*a* on the flanks of the TCPs 53 is electrically connected to the input terminals SPin, CKin, R1in to R6in, G1in to G6in, B1in to B6in, LSin, Vref1in to Vref6in, VLS, Vcc, and GND and to the output terminals SPout, CKout, R1out to R6out, G1out to G6out, B1out to B6out, LSout, Vref1out to Vref6out, VLS, Vcc, and GND, whereas FIG. 19 shows only four lines of the TCP wiring 53*a*. Note also that FIG. 19 shows only two lines of the source driver connection wiring 54*d* that, however, actually is constituted by the number of lines that corresponds to the input terminals SPin, CKin, R1in to R6in, G1in to G6in, B1in to B6in, LSin, Vref1in to Vref6in, VLS, Vcc, and GND.

According to this method, the source driver connection wiring 54*d* on the liquid crystal panel 54 is used to electrically connect adjacent TCPs 53. Alternatively, the TCP wiring 53*a* of adjacent TCPs 53 may be stacked one over the other to electrically connect those adjacent TCPs 53. The method of stacking the TCP wiring 53*a* of adjacent TCPs 53 to establish connection between the TCP wiring 53*a* is disclosed in Japanese Laid-Open Patent Application No. 6-3684/1994 (Tokukaihei 6-3684: published on Jan. 14, 1994) filed by the same applicants as the present application.

As explained in the foregoing, the flexible substrate (or printed substrate) for supplying common signals and power supply associated voltages to the source driver LSI chips 71 becomes dispensable if the common signals and power supply associated voltages transmitted between adjacent TCPs 53 via the TCP wiring 53*a* and the internal wiring of the source driver LSI chips 71. The elimination of the flexible substrate hence allows the liquid crystal module to be reduced in price and size.

However, new schemes are essential to meet strong commercial needs for even cheaper and more compact liquid crystal modules. Therefore, to reduce the total cost of the liquid crystal module, the size and number of the circuits and wires included in the display drive device with a controller are required be reduced to a greatest possible extent.

SUMMARY OF THE INVENTION

In view of the foregoing conventional problem, the present invention has an object to offer a display drive device that has a reduced overall size including a controller and other members, and that can be built at a reduced cost, and has another object to offer a liquid crystal module using such a device.

To achieve the objects, a display drive device of the present invention includes a plurality of cascade connected drive circuits for driving a display element in accordance with an image data signal, each of the drive circuits including a hold memory for latching a predetermined amount of the time division incoming image data signal in accordance with a latch signal, each of the drive circuits converting the latched image data signal to an analog signal and supplying the analog signal to the display element, wherein a latch signal generator circuit for generating the latch signal is disposed in one of the drive circuits which is in a last stage.

With the arrangement, a plurality of drive circuits are cascade connected to drive a display element in accordance with an image data signal. Specifically, each of the drive circuits has a hold memory for latching a predetermined amount of the time division incoming image data signal in accordance with a latch signal, and the image data signal latched by the hold memory is converted to analog and supplied to the display element.

Unlike conventional display drive devices, the display drive device is capable of internally generating a latch signal in the foregoing manner, and can dispense with an external supply of a latch signal by a controller or the like. Therefore, the display drive device can dispense with circuits, in an external circuit, associated with the latch signal, output terminals of the external circuit, and latch signal transmitting wiring for electrically connecting the external circuit to the display drive device, which are all required with a conventional display drive device to supply a latch signal from the external circuit. This arrangement enables the display drive device, including a controller, etc., to be produced in a reduced overall size and at a lower cost.

For a fuller understanding of the nature and advantages of the invention, reference should be made to the ensuing detailed description taken in conjunction with the accompanying drawings.

DESCRIPTION OF THE EMBODIMENTS

Embodiment 1

Referring to FIG. 1 to FIG. 6 and FIG. 13, the following description will explain an embodiment in accordance with the present invention.

Figure 2:
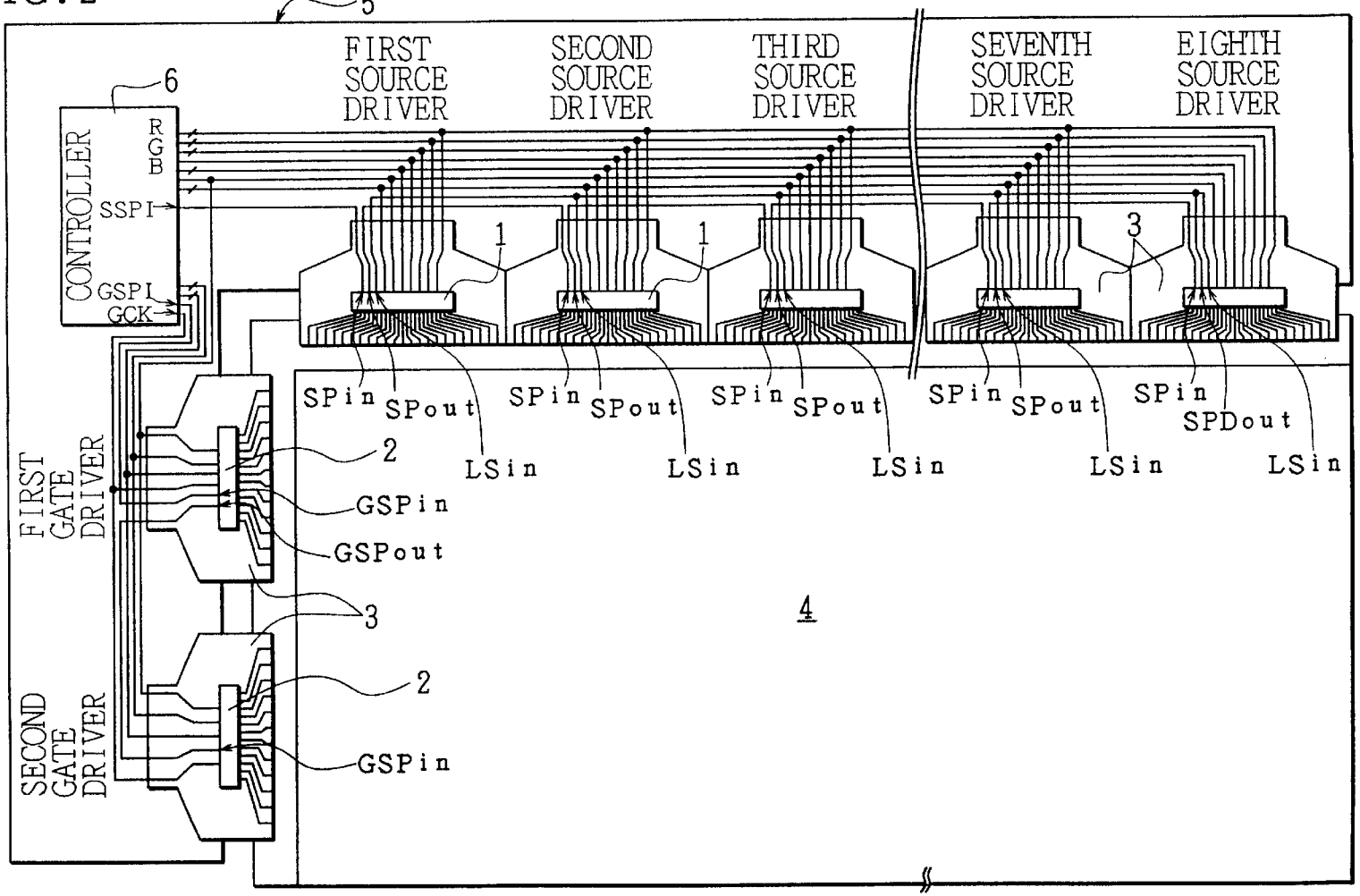
FIG. 2 is a plan view showing an embodiment of a liquid crystal module using the aforementioned display drive device.
Figure 3:
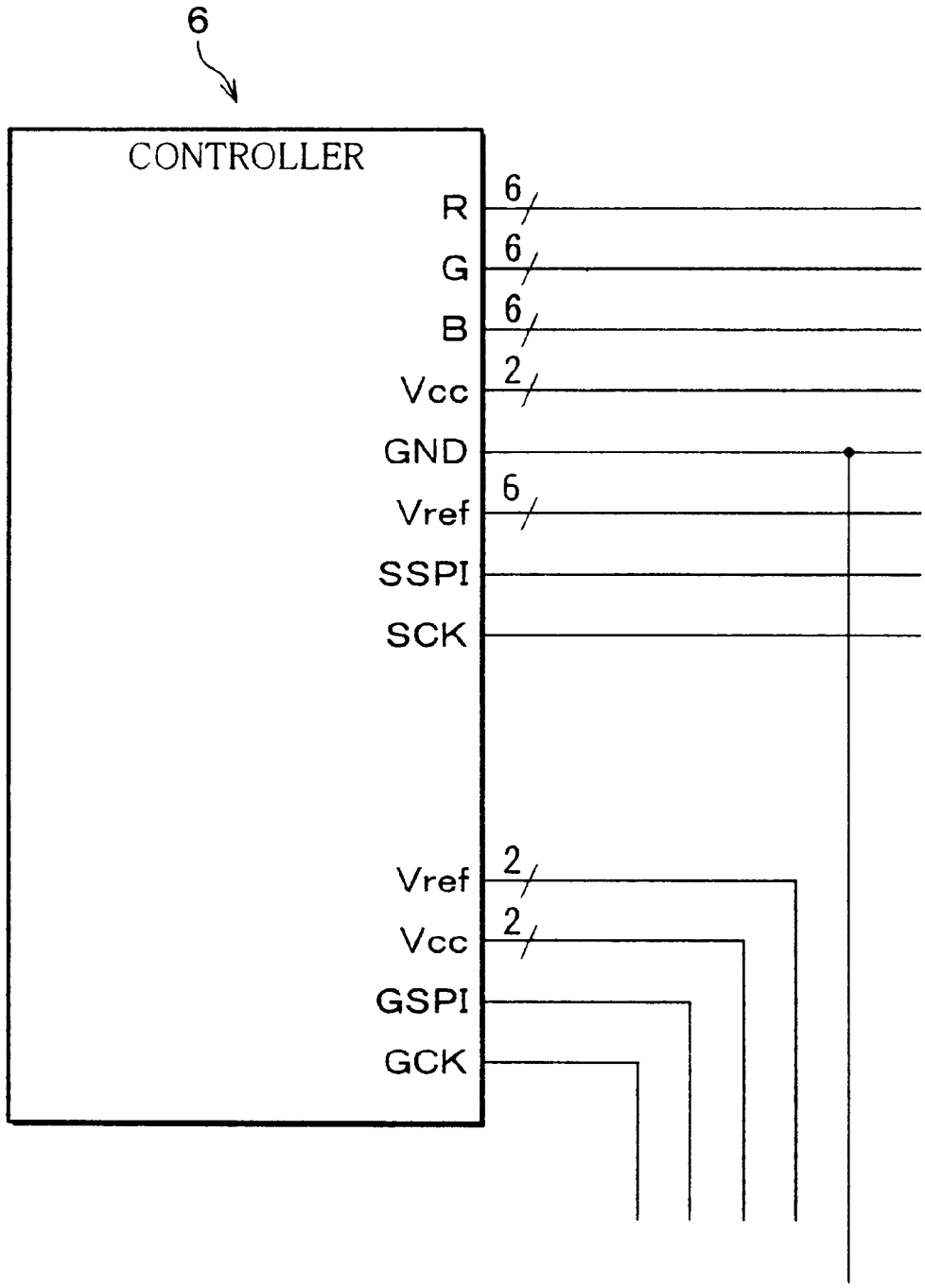
FIG. 3 is an enlarged view showing a part, including a controller, of the liquid crystal module.

As shown in FIG. 2, a display drive device of the present embodiment includes source driver LSI chips 1 and gate driver LSI chips 2 mounted on TCPs 3 to act as a plurality of cascade-connected drive circuits for driving a liquid crystal panel 4 as a liquid crystal display element (display element). The display drive device, together with the liquid crystal panel 4, constitutes a liquid crystal module. Note that the liquid crystal panel 4 has 800×3(RGB) [source side]× 600 [gate side] pixels.

Figure 13:
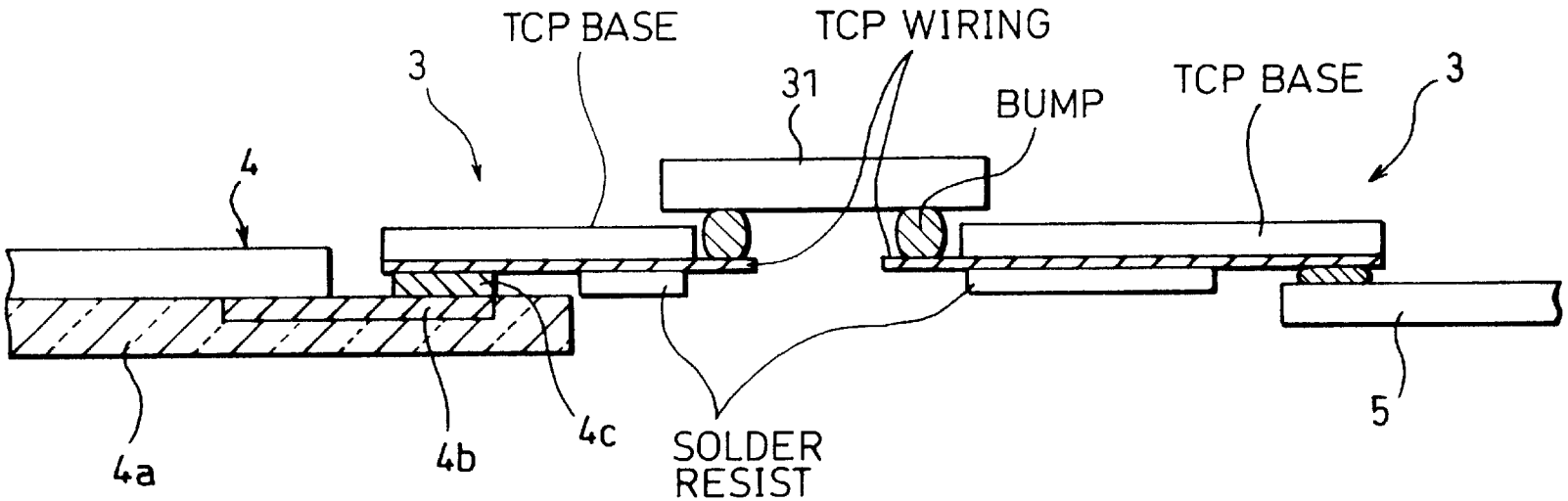
FIG. 13 is a cross-sectional view showing mounting of TCPs on a liquid crystal panel in the liquid crystal module.

The source and gate driver LSI chips 1 and 2 have output terminals electrically connected via TCP wiring on the TCPs 3 to output terminals of the TCPs 3 for output to the liquid crystal panel 4. Output terminals (TCP wiring) to the liquid crystal panel 4 of the TCP 3 are, as shown in FIG. 13, electrically connected and fixed by thermocompression bonding via, for example, an ACF 4*c* to an ITO terminal 4*b* disposed on the liquid crystal glass substrate 4*a* of the liquid crystal panel 4. Further, the source driver LSI chip 1 (denoted as 31 in FIG. 13) is connected via bumps to TCP wiring (inner lead section). The later-mentioned wiring of the flexible substrate 5, as well as the TCP wiring, are electrically connected and fixed by an ACF or soldering. The TCP wiring is covered by solder resist for protection except connecting parts. Sealing materials for providing protection to the source driver LSI chip 31 are omitted from the illustration in FIG. 13.

Each of the source driver LSI chips 1 drives 100×3 (RGB) pixels and carry out a 64 half-tone display. Therefore, there are eight cascade connected source driver LSI chips 1 here. Hereinafter, to distinguish each of the source driver LSI chips 1 from the others, those located in first to seventh stages will be referred to as first to seventh source drivers respectively, with the source driver LSI chip 1 located in a last stage referred to as an eighth source driver.

There are two cascade connected gate driver LSI chips 2 here. Hereinafter, to distinguish each of the gate driver LSI chips 2 from the other, the gate driver LSI chips 2 in first and last stages will be referred to as first and last gate drivers respectively.

Further, the display drive device includes a flexible substrate 5 with a controller 6, and the flexible substrate 5 is electrically connected to the TCPs 3. Specifically, the TCP wiring on the TCPs 3 electrically connected to the source driver LSI chips 1 and the gate driver LSI chips 2 is electrically connected via, for example, an ACF or soldering to the wiring on the flexible substrate 5 electrically connected to the output terminals R, G, B, Vcc, GND, Vref, VLS, SSPI, SCK, GCK, and GSPI (see FIG. 3) of the controller 6.

This configuration allows signals to travel to and from the source and gate driver LSI chips 1 and 2 via the wiring on the TCPs 3 and the flexible substrate 5.

First, the image data signals R, G, and B and the clock signal CK provided by the controller 6 at its output terminals R, G, B and SCK respectively are fed to the source driver LSI chips 1 as common signals via the wiring on the flexible substrate 5 and the TCPs 3.

Meanwhile, the start pulse signal SPI provided by the controller 6 at its output terminal SSPI is transmitted via the wiring on the flexible substrate 5 and coupled to the input terminal SPin for input to the first source driver. The first source driver internally transmits the received start pulse signal SPI and provides a start pulse signal SPO at its output terminal SPout. The outgoing start pulse signal SPO is transmitted again through the wiring on the flexible substrate 5 and coupled to the input terminal SPin for input to a following-stage, second source driver. Then, similarly to the foregoing, the start pulse signal SPI is transmitted sequentially from the second source driver to the eighth source driver, that is, to the source driver in the last stage.

Similarly, the controller 6 provides, as outputs, a power supply voltage Vcc for LSI chips at its output terminal Vcc, reference voltages Vref1 to Vref6 for a 64 bit half-tone display at its output terminals Vref1 to Vref6, and a brightness adjusting voltage (voltage for adjusting the voltage applied to the liquid crystal panel 4) VLS at its output terminal VLS; all these voltages, as well as a ground potential GND electrically connected to the controller 6 via its output terminal GND, are supplied commonly to each of the source driver LSI chips 1. The wiring to supply these voltages Vcc, Vref1 to Vref6, and VLS and the ground connection line (GND line) to supply the ground potential GND are disposed as power supply associated lines. Hereinafter, the voltages Vcc, Vref1 to Vref6, and VLS, and the ground potential GND will be referred to as power supply associated voltages.

Figure 14:
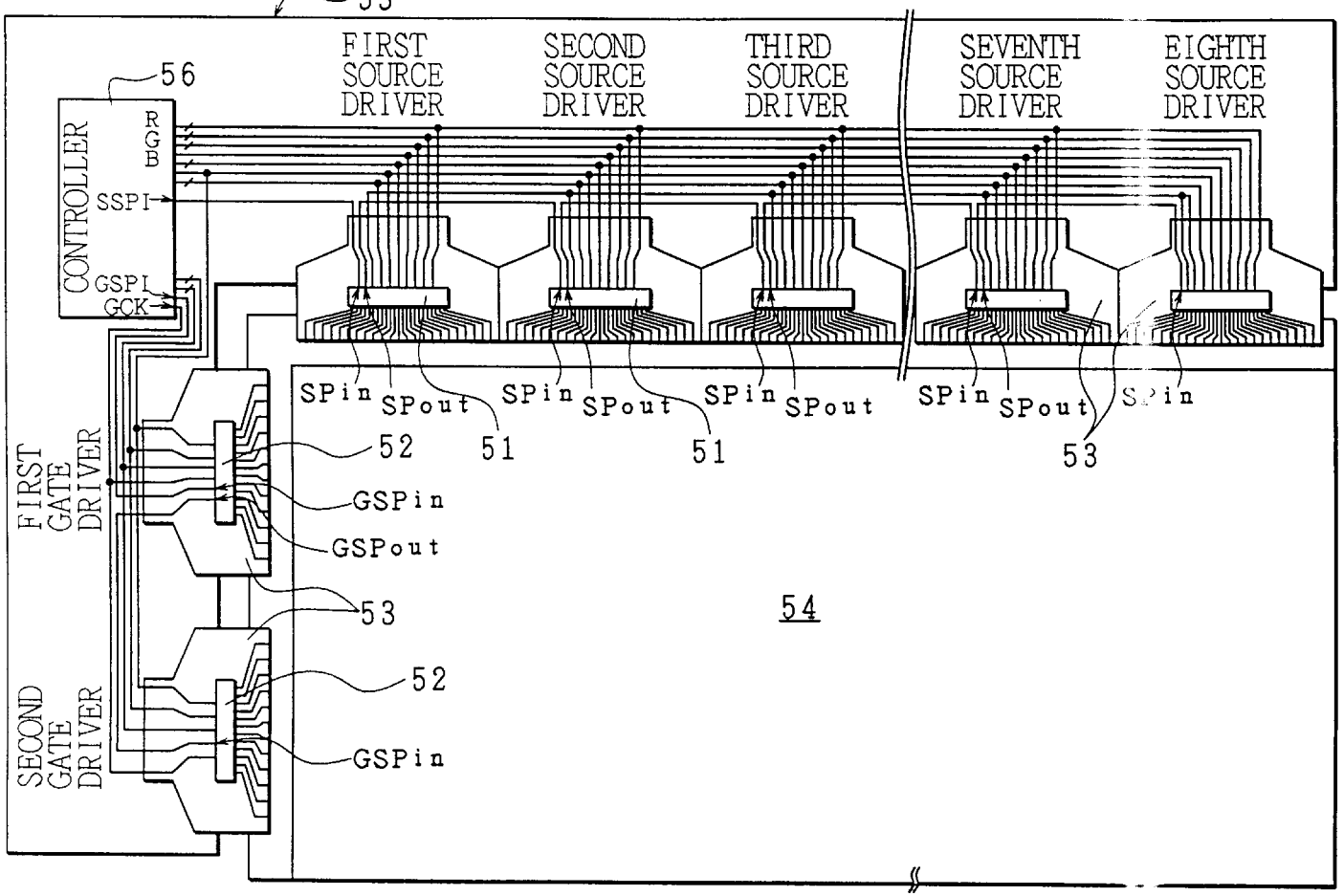
FIG. 14 PRIOR ART
FIG. 14 is a plan view showing an arrangement of a conventional liquid crystal module.
Figure 15:
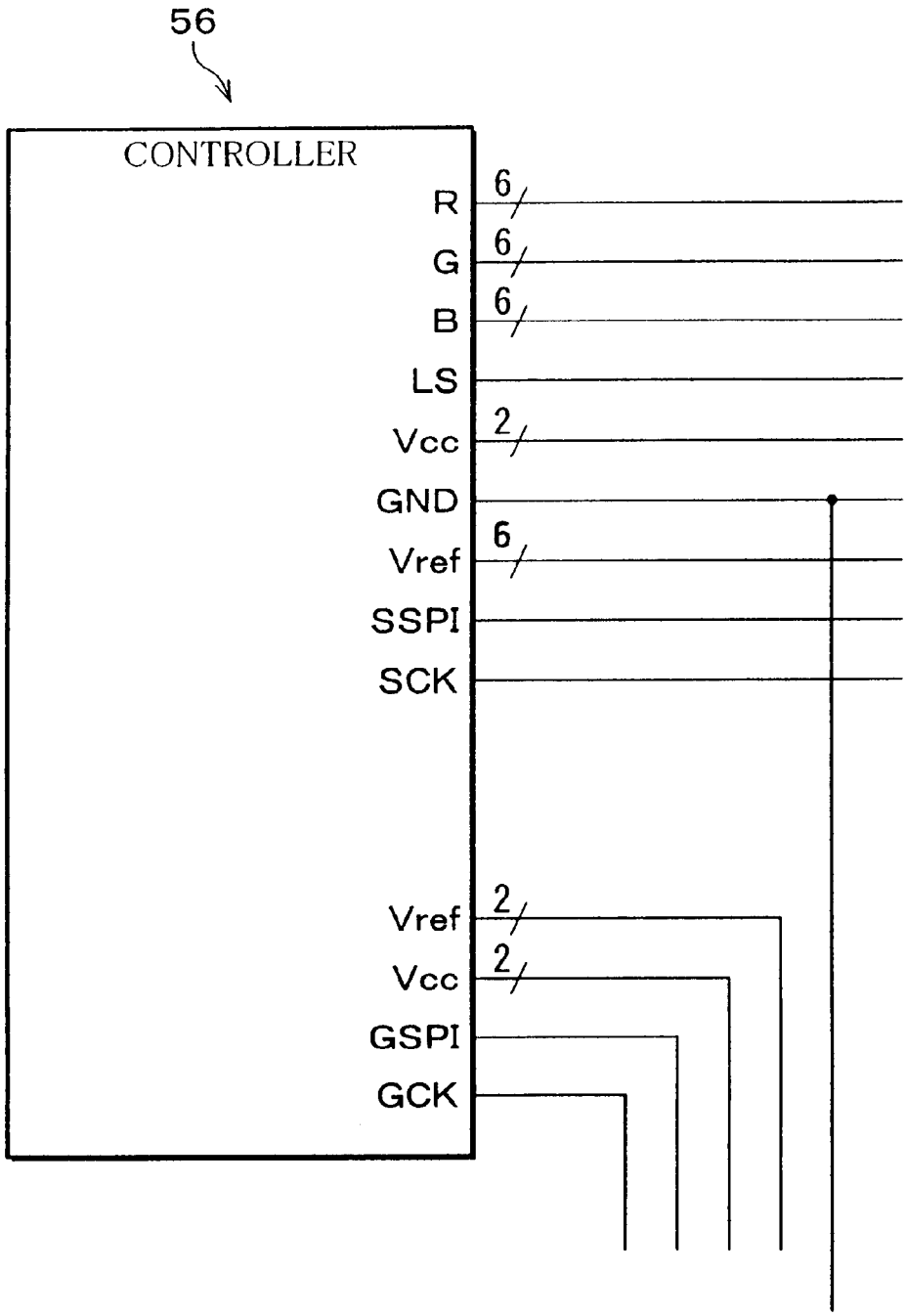
FIG. 15 PRIOR ART
FIG. 15 is an enlarged view showing a part, including a controller, of the liquid crystal module.
Figure 16:
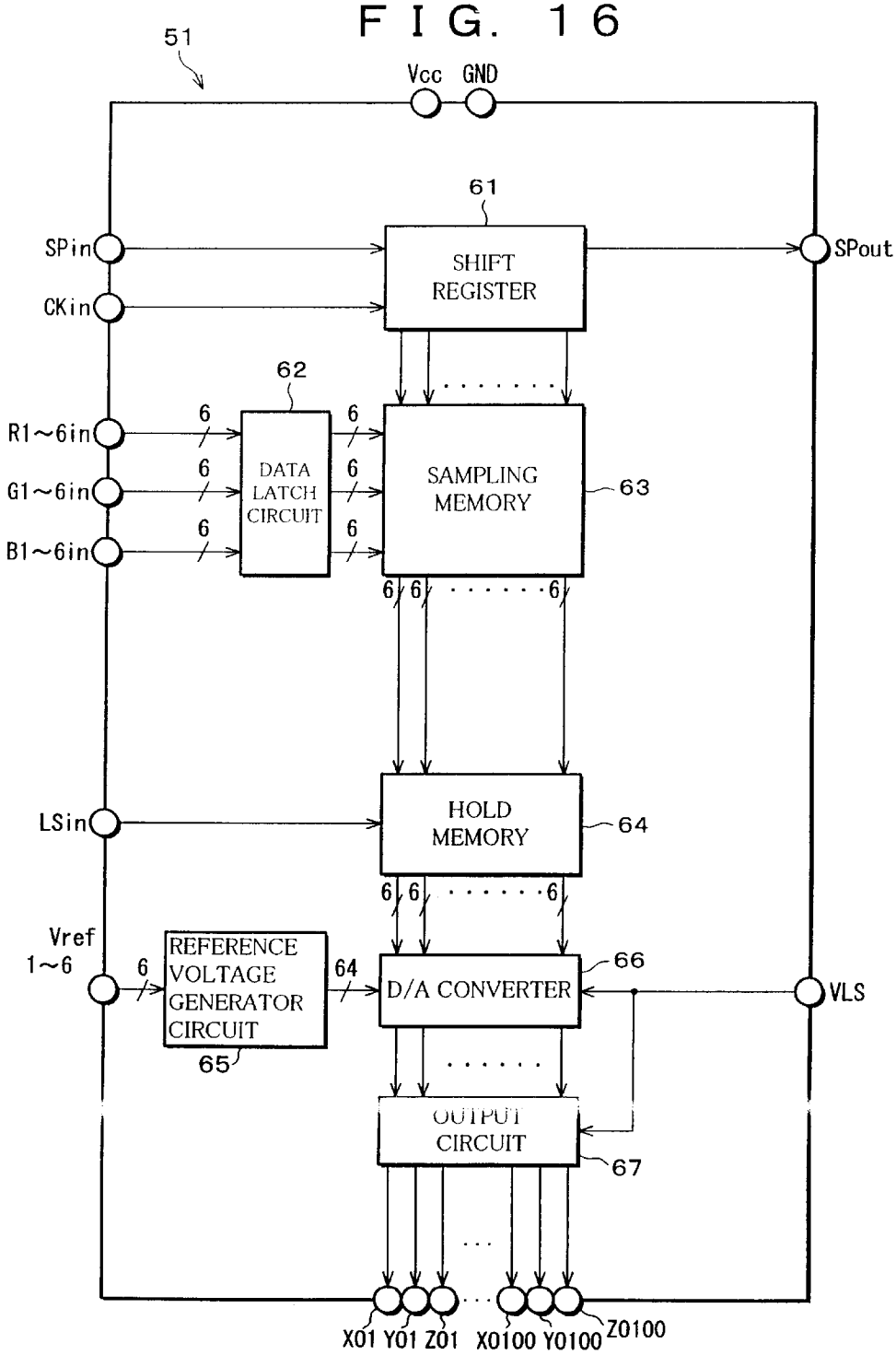
PRIOR ART FIG. 16
FIG. 16 is a block diagram showing an arrangement of a source driver LSI chip in the liquid crystal module.
Figure 17:
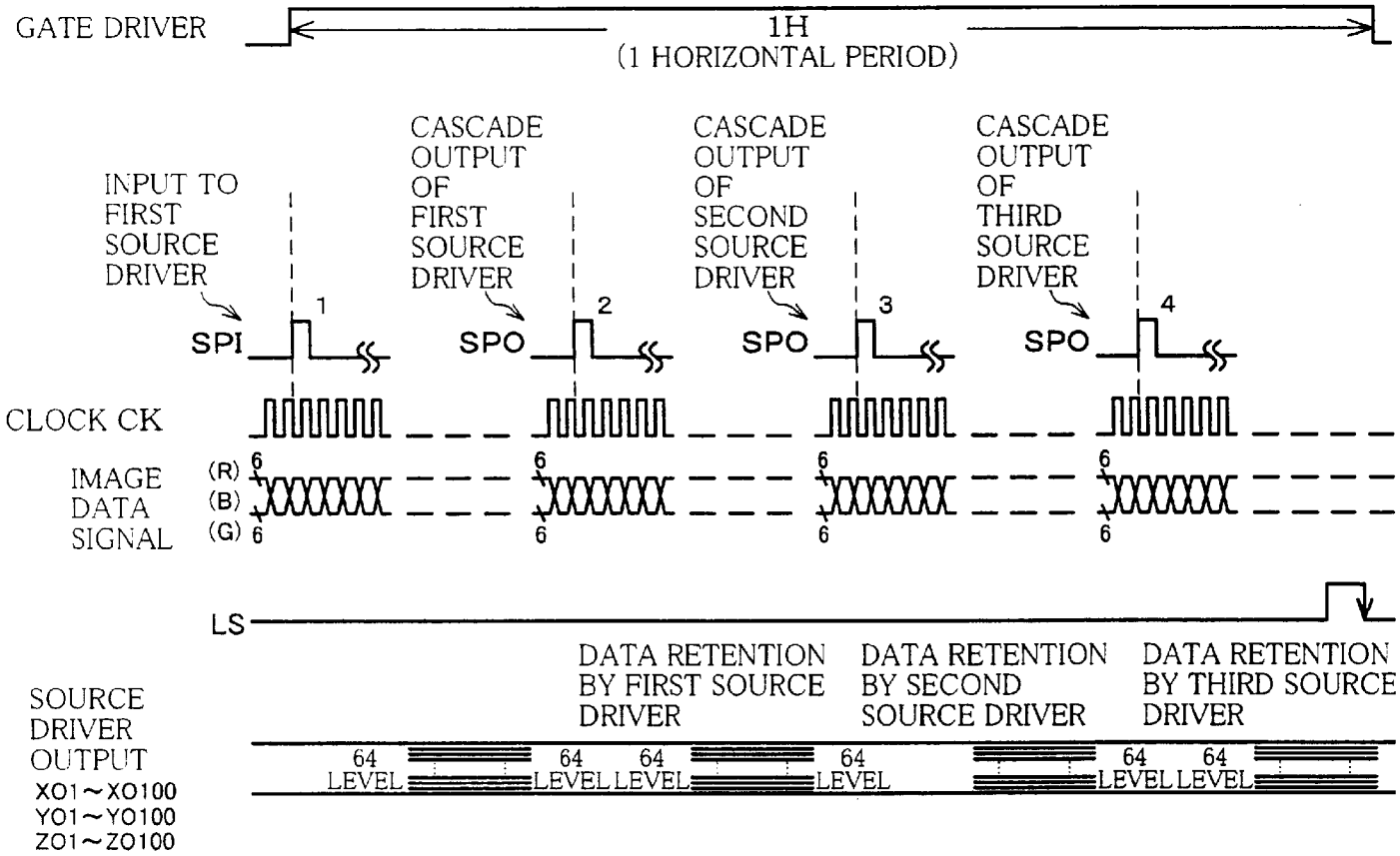
FIG. 17 PRIOR ART
FIG. 17 is timing charts showing various signals of the source driver LSI chip.

In regard of the description above, the display drive device of the present embodiment is substantially the same as the conventional display drive device shown in FIG. 14. Difference from the conventional technology lies in that in the conventional display drive device, the latch signal LS is supplied by the controller 56 via its output terminal LS, whereas in the display drive device of the present embodiment, the start pulse signal supplied by the last-stage, that is, eighth source driver, via its output terminal SPDout is used as the latch signal LS.

In other words, in the present embodiment, the start pulse signal of the eighth source driver is supplied to the source driver LSI chips 1 as a latch signal LS, by connecting the output terminal SPDout of the eighth source driver for output of the start pulse signal to the input terminals LSin of the first to eighth source drivers for input of the latch signal LS.

This configuration eliminates the need for the controller 6 to supply the latch signal LS, rendering unnecessary the wiring for supplying the latch signal LS from the controller 6 to the first source driver 1, the output terminal LS of the controller 6, the circuit disposed in the controller 6 in association with the output of the latch signal LS, etc.

Further, in the present embodiment, the outgoing start pulse signal supplied by the eighth source driver via its output terminal SPDout is a signal which is obtained by delaying an ordinary start pulse signal SPO in the delay circuit 13. The start pulse signal SPO per se of the eighth source driver is not used as the latch signal LS for the following reason.

Figure 4:
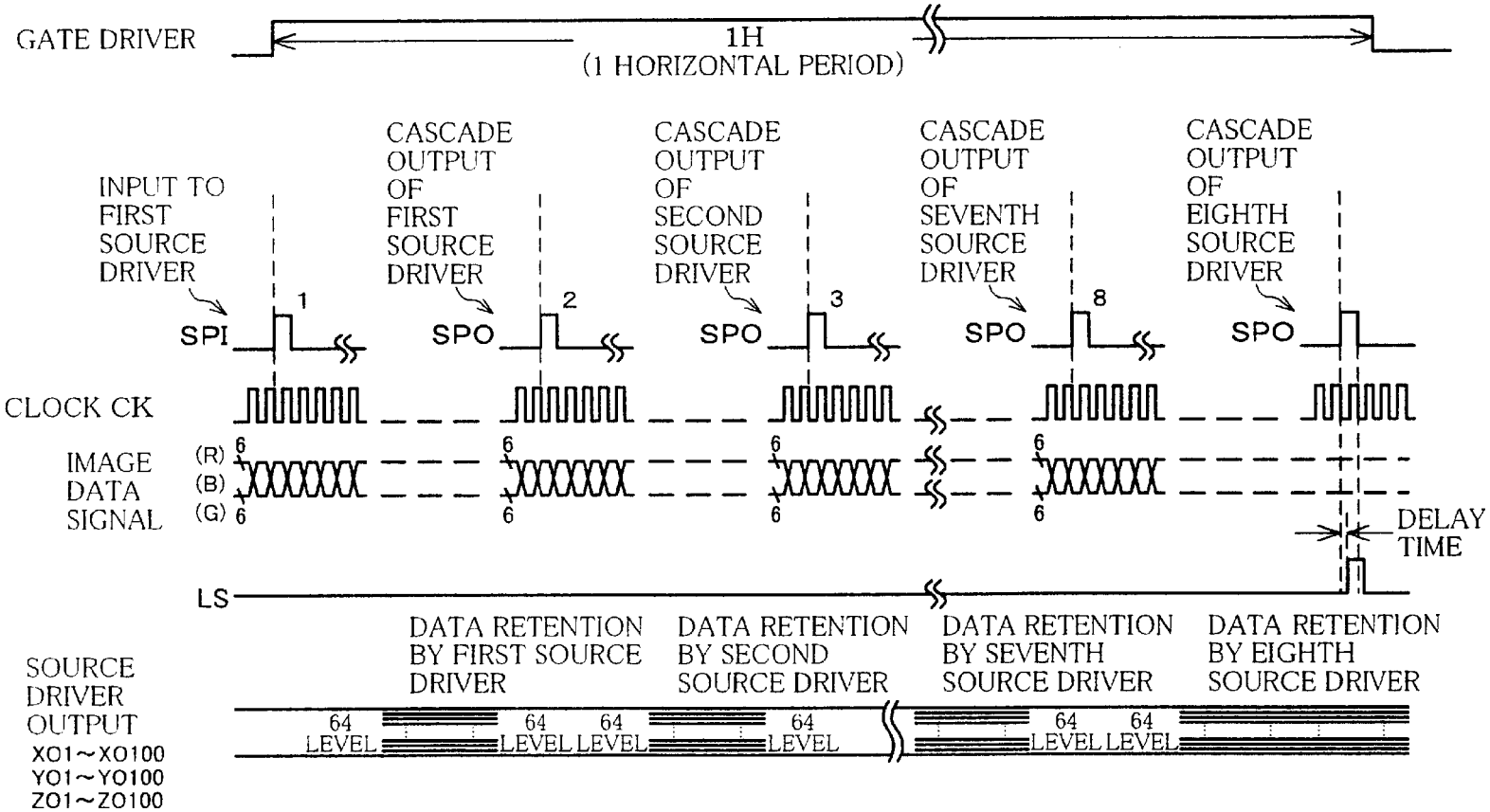
FIG. 4 is timing charts showing various signals of the source driver LSI chip.

As illustrated in FIG. 4 showing timing charts of input and output signals, if the start pulse signal SPO per se of the eighth source driver is used as the latch signal LS, and latched by the hold memory 17 at, for example, the rising edge of the latch signal LS, the transmitted image data signals R, G, and B possibly may not be latched due to the delay of the image data signals R, G, and B in the data latch circuit 14 and the sampling memory 15. Therefore, the present embodiment includes such an arrangement that the delay circuit 13 effects delays on the start pulse signal.

Figure 1:
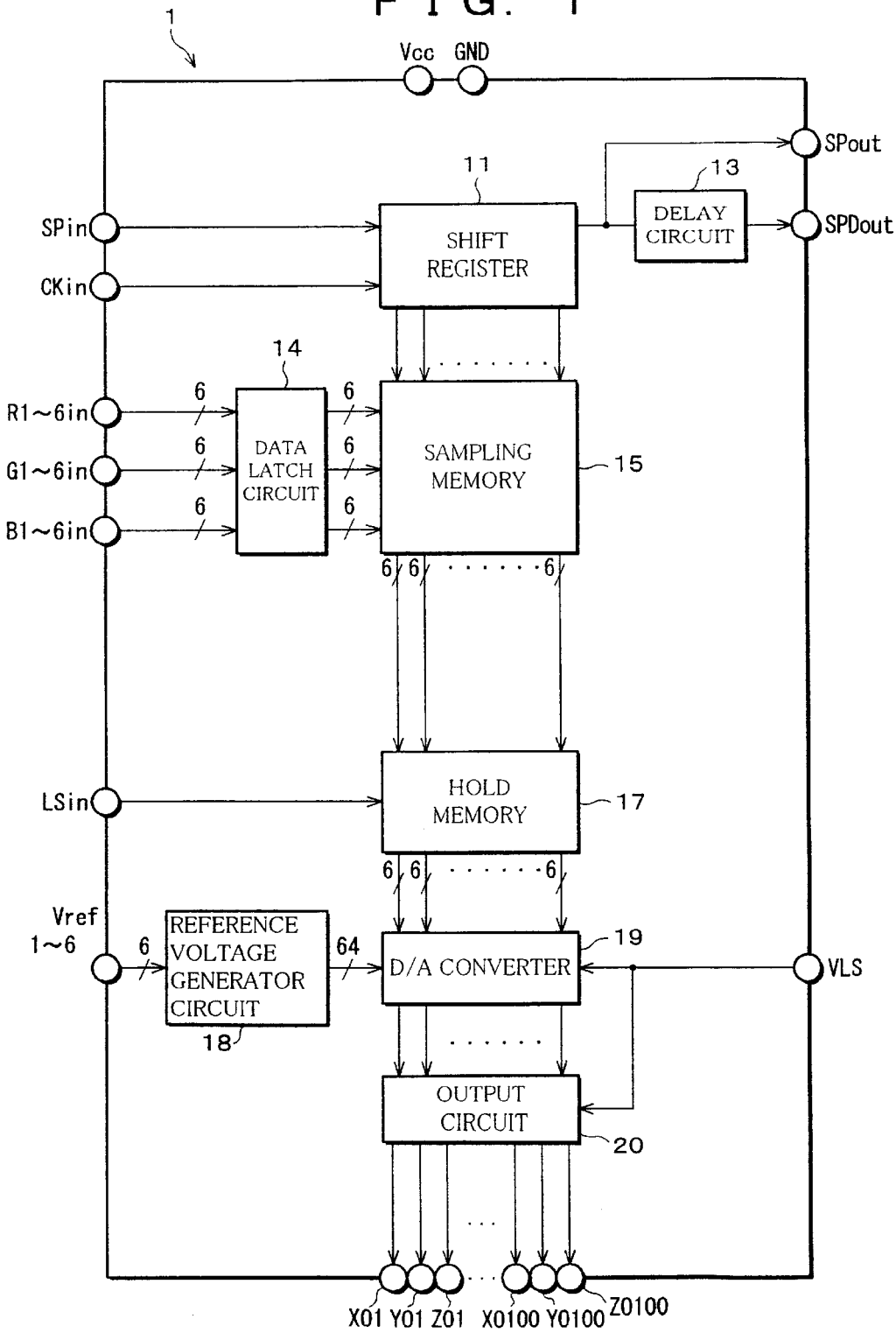
FIG. 1 is a block diagram showing an arrangement of a source driver LSI chip of an embodiment of the display drive device in accordance with the present invention.

The following description will explain a circuit arrangement of the source driver LSI chip 1 in detail in reference to the block diagram constituting FIG. 1, and also operations of the source driver LSI chip 1 in reference to the signal timing charts constituting FIG. 4. Note that the following description deals with one of the eight source driver LSI chips 1 shown in FIG. 2; however, the source driver LSI chips 1 are all identical.

As shown in FIG. 1, the source driver LSI chip 1 is arranged to include a shift register 11, a data latch circuit 14, a sampling memory (selection circuit) 15, a hold memory (latch circuit) 17, a reference voltage generator circuit 18, a D/A converter 19, and an output circuit 20.

The shift register 11 receives, from the input terminal SPin of the source driver LSI chip 1, a start pulse signal SPI (see FIG. 4) supplied by the controller 6 via its output terminal SSPI. The start pulse signal SPI is a synchronized signal in synchronization with the later-mentioned horizontal synchronized signals of the image data signals R, G, and B. Further, the shift register 11 receives, from the input terminal CKin of the source driver LSI chip 1, the clock signal CK (see FIG. 4) provided by the controller 6 at its output terminal SCK.

The shift register 11 receives and shifts the start pulse signal SPI. Specifically, using the start pulse signal SPI as a start pulse, the shift register 11 starts shifting the start pulse signal SPI when the clock signal CK received rises for the first time while the start pulse signal SPI is in high level.

The start pulse signal SPI shifted by the shift register 11 is provided as a start pulse signal SPO (see FIG. 4) by the source driver LSI chip 1 at its output terminal SPout and coupled to the input terminal SPin of a following-stage source driver LSI chip 1. Then, similarly to the foregoing, the start pulse signal SPI is transmitted sequentially to the eighth source driver shown in FIG. 2, that is, to the source driver LSI chip 1 in the last stage.

Meanwhile, as shown in FIG. 1, the image data signals R, G, and B (see FIG. 4) provided by the controller 6 at the R, G, and B terminals respectively are coupled to the input terminals R1in to R6in, G1in to G6in, and B1in to B6in of the source driver LSI chip 1 and fed as parallel inputs to the data latch circuit 14. The image data signals R, G, and B are then temporarily latched by the data latch circuit 14 and transmitted to the sampling memory 15. Note that the image data signals R, G, and B are color digital image signals representing a 6-bit R (Red) set of data, a 6-bit G (Green) set of data, and a 6-bit B (Blue) set of data, collectively representing 18-bit data.

The sampling memory 15 performs sampling on the image data signals R, G, and B transmitted in a time division manner as output signals from the stages in the shift register 11, and stores the sampled signals until the sampling memory 15 receives a later-mentioned latch signal LS (see FIG. 4).

The hold memory 17 then receives inputs of the image data signals R, G, and B, and latches the signals at a trailing edge of the latch signal LS upon reception of a set of data for a horizontal period. The hold memory 17 holds the set of data for a horizontal period carried on the image data signals R, G, and B, until reception of a set of data for a next horizontal period from the sampling memory 15. During that period, the hold memory 17 provides the image data signals R, G, and B for output to the D/A converter 19. Here, the shift register 11 and the sampling memory 15 receive a new set of image data signals R, G, and B for a next horizontal period.

The reference voltage generator circuit 18 produces 64 levels used for a half-tone display by, for example, resisance division according to the reference voltages Vref1 to Vref6 which are provided as outputs by the controller 6 at its output terminals Vref1 to Vref6 and then coupled to the input terminals Vref1 to Vref6 of the source driver LSI chip 1.

The D/A converter 19 converts the image data signals R, G, and B, which are 6-bit R, G, and B digital image signals respectively, into analog signals. The output circuit 20 then amplifies the analog signals of 64 levels using the brightness adjusting voltage VLS which is provided as an output by the controller 6 at its output terminal VLS and then coupled to the input terminal VLS of the source driver LSI chip 1. Thereafter the output circuit 20 provides, at its output terminals XO1 to XO100, YO1 to YO100, and ZO1 to ZO100, the amplified signals which will be coupled to input terminals (not shown) of the liquid crystal panel 4.

The output terminals XO1 to XO100 constitute a terminal group of 100 terminals for the image data signals R, the output terminals YO1 to YO100 for the image data signals G, and the output terminals ZO1 to ZO100 for the image data signals B. Also, the terminals Vcc and GND of the source driver LSI chip 1 are for providing a power supply to the source driver LSI chip 1. Note that input and output buffer circuits are omitted in FIG. 1.

Figure 18:
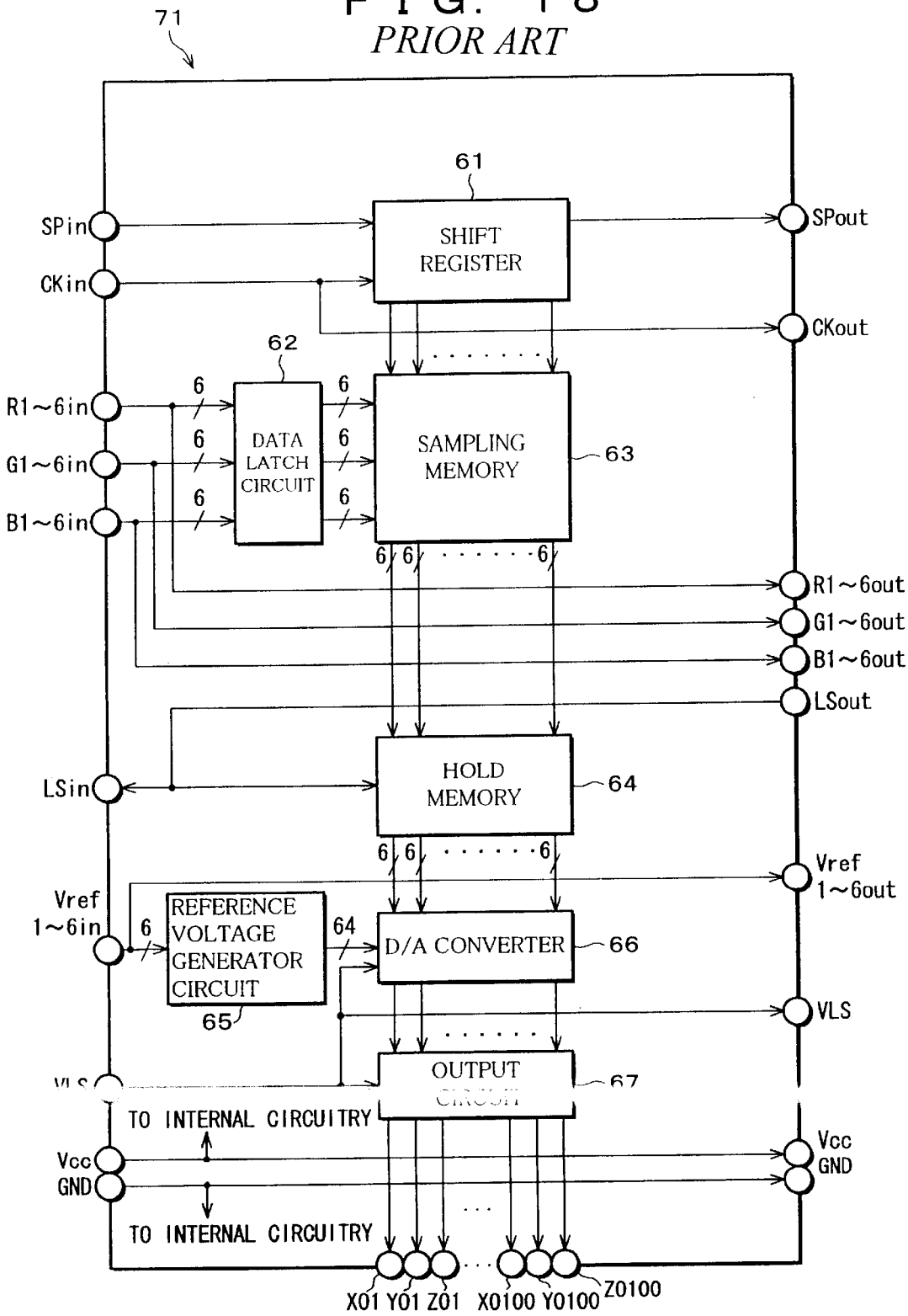
FIG. 18 PRIOR ART
FIG. 18 is a block diagram showing an arrangement of a source driver LSI chip in another conventional liquid crystal module.

In regard of the description above, the source driver LSI chip 1 of the present embodiment is substantially the same as the conventional source driver LSI chip 51 shown in FIG. 18. Difference lies in that the source driver LSI chip 1 of the present embodiment has a delay circuit (latch signal generator means) 13 disposed immediately downstream of the shift register 11 while the source driver LSI chip 1 does not.

The source driver LSI chip 1 has an output terminal SPout for an outgoing start pulse signal SPO provided at the same timing with the conventional technology, and an output terminal SPDout for an outgoing start pulse signal provided at a timing delayed by a predetermined time by the disposition of the delay circuit 13.

The output terminal SPout of the first source driver is electrically connected to the input terminal SPin of the second source driver. Similarly to the foregoing, the output terminals SPout of the second to seventh source drivers are electrically connected respectively to the input terminals SPin of the third to eighth source drivers. Meanwhile, the output terminal SPDout of the eighth source driver is electrically connected to the input terminals LSin of the first to eighth source drivers.

Figure 5:
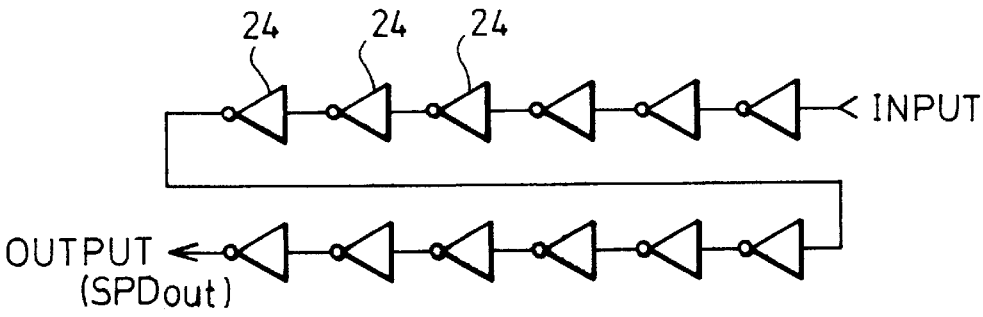
FIG. 5 is a circuit diagram showing, as an example, an arrangement of a delay circuit in the source driver LSI chip.

The delay circuit 13 is arranged by connecting an even number of inverter circuits 24 in series as shown in FIG. 5.

Figure 6:
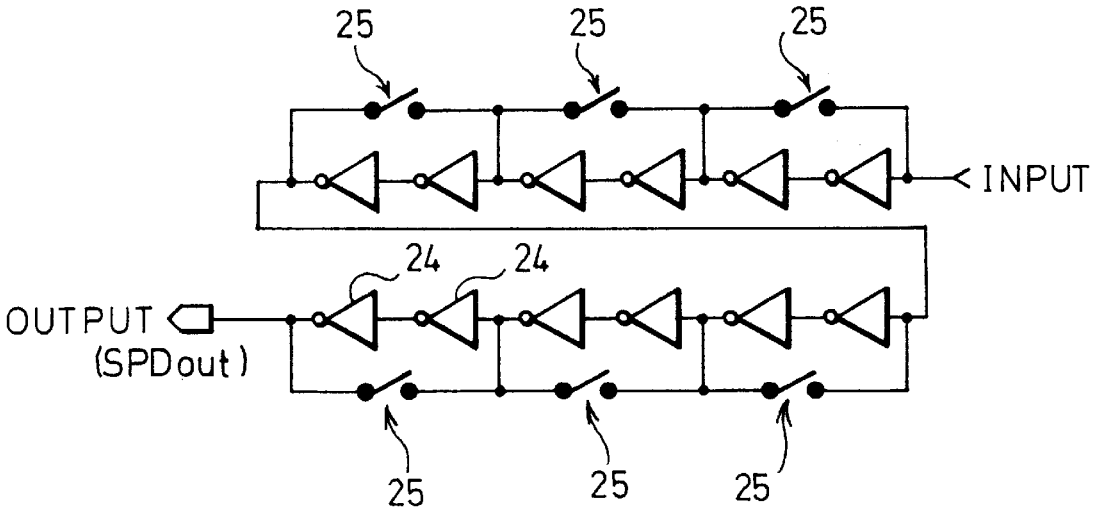
FIG. 6 is a circuit diagram showing, as another example, an arrangement of a delay circuit in the source driver LSI chip.

Alternatively, switches may be disposed as shown in FIG. 6 so that each of them correspond to a plurality of inverter circuits 24 constituting the delay circuit 13. The delay time is adjustable by opening and closing the switches 25.

The adjustment in the delay time allows adjustment and optimization of the timing of the latch signal LS and the image data signals R, G, and B in the source driver LSI chips 1 as explained earlier in reference to FIG. 4, and of the timing of the latch signal LS and the image data signals R, G, and B when the delay circuit 13 is mounted on the liquid crystal panel 4.

The delay circuit 13 may be a delay circuit for effecting a delay by a CR time constant of a combined capacitor and resistor.

The opening and closing of the switches 25 depend on, for example, metal option, that is, whether the wires are made by the metal of the top layer composing the source driver LSI chip 1. By the use of metal option, it takes less time to adjust the timing.

Alternatively, the switches 25 may be closed in advance by interconnecting them through a metal in the top layer and thereafter opened by cutting the metal by, for example, laser cutting technique using a laser. This facilitates closing and opening of the switches 25.

Note that in the display drive device of the present embodiment, the first to the seventh source drivers are arranged identically to the eighth source driver; however, the delay circuits 13 and the output terminals SPDout may be omitted from the first to seventh source drivers. Specifically, the conventional source driver LSI chips 51 detailed in the Background of the Invention may be used in place of the first to seventh source drivers.

From the foregoing discussion, with the display drive device of the present embodiment, less signals are needed to be transmitted from the controller 6, in comparison with a conventional arrangement where the latch signal LS is supplied by the controller 6; therefore, less lines are needed in the wiring to establish electrical connection between the controller 6 and the source driver LSI chips 1. Thus, the wiring can be reduced in cost, and the flexible substrate 5 on which the wiring is disposed to electrically connect the controller 6 and the source driver LSI chips 1 can be reduced in size.

Further, with the arrangement, the circuits disposed inside the controller 6 in association with the latch signal LS and the output terminals LS of the controller 6 can be reduced in number, leading to cost reductions for the controller 6. Consequently, the liquid crystal module including the controller 6 can be built even thinner and lighter, paving a way to successfully building a more compact liquid crystal display device suitably responding to needs of the user.

Further, with the arrangement, a single delay circuit 13, since being disposed immediately downstream of the shift register 11 in the last-stage, eighth source driver, is capable of supplying the latch signal LS to all the source driver LSI chips 1. Therefore, the increase in cost and size of the device as a result of the disposition of a plurality of delay circuits 13 can be avoided.

Embodiment 2

Figure 7:
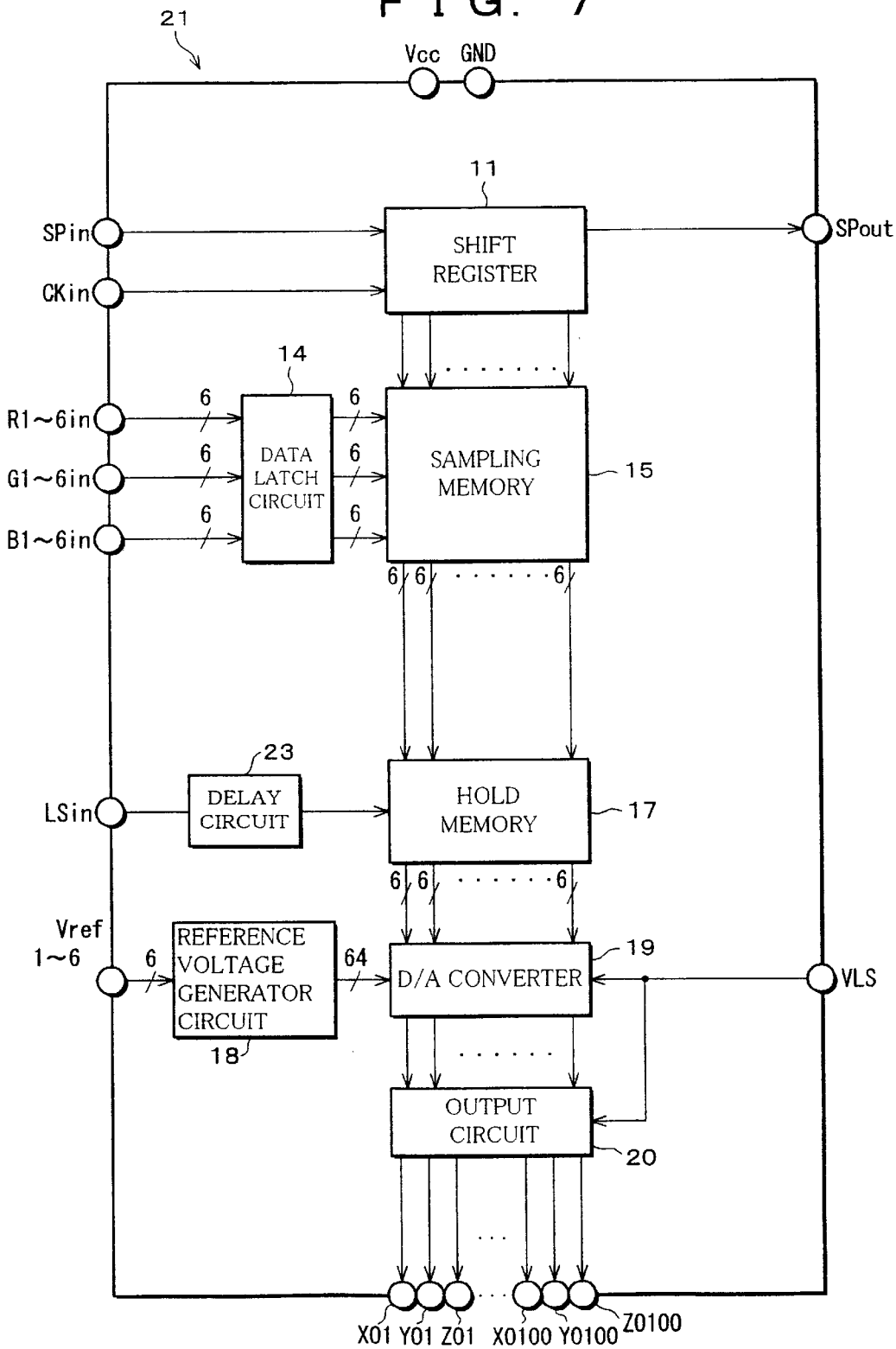
FIG. 7 is a block diagram showing an arrangement of a source driver LSI chip of another embodiment of the display drive device in accordance with the present invention.

Referring to FIG. 7, the following description will explain another embodiment of the present invention. Here, for convenience, members of the present embodiment that have the same arrangement and function as members of the previous embodiment, and that are mentioned in the previous embodiment are indicated by the same reference numerals and description thereof is omitted.

As shown in FIG. 7, the source driver LSI chip 21 of the present embodiment includes the arrangement shown in FIG. 1, and is therefore identical to the source driver LSI chip 1 of the first embodiment, except that in the source driver LSI chip 21, the delay circuit 13 and the output terminal SPDout are omitted, and a delay circuit 23 is interposed between the input terminal LSin and the hold memory 17. The delay circuit 23 is identical to the delay circuit 13 of the first embodiment.

The display drive device and the liquid crystal module (not shown) of the present embodiment are identical to the display drive device and the liquid crystal module of the first embodiment 1, except that in those of the present embodiment, the source driver LSI chip 1 is replaced by the source driver LSI chip 21.

In the present embodiment, the latch signal LS shown in FIG. 4 is applied to the hold memory 17 at a delayed timing effected by the output of the delay circuit 23 in the source driver LSI chip 21.

Similarly to the first embodiment, the display drive device and the liquid crystal module of the present embodiment adjust and optimize the timing of the latch signal LS and the image data signals R, G, and B in the source driver LSI chip 21 and also the timing of the latch signal LS and the image data signals R, G, and B when mounted on the liquid crystal panel 4.

Further, in the present embodiment, the disposition of a delay circuit 23 immediately upstream of the hold memory 17 in each source driver LSI chip 21 (between the input terminal LSin and the hold memory 17) allows the source driver LSI chip 21 to externally supply the start pulse signal SPO per se that is provided as an output by the shift register 11. The source driver LSI chip 21 therefore can dispense with the output terminal SPDout for externally supplying the output signal provided by the delay circuit 13, and therefore can be manufactured at lower cost with better efficiency, in comparison with the source driver LSI chip 1 of the first embodiment.

Embodiment 3

Figure 8:
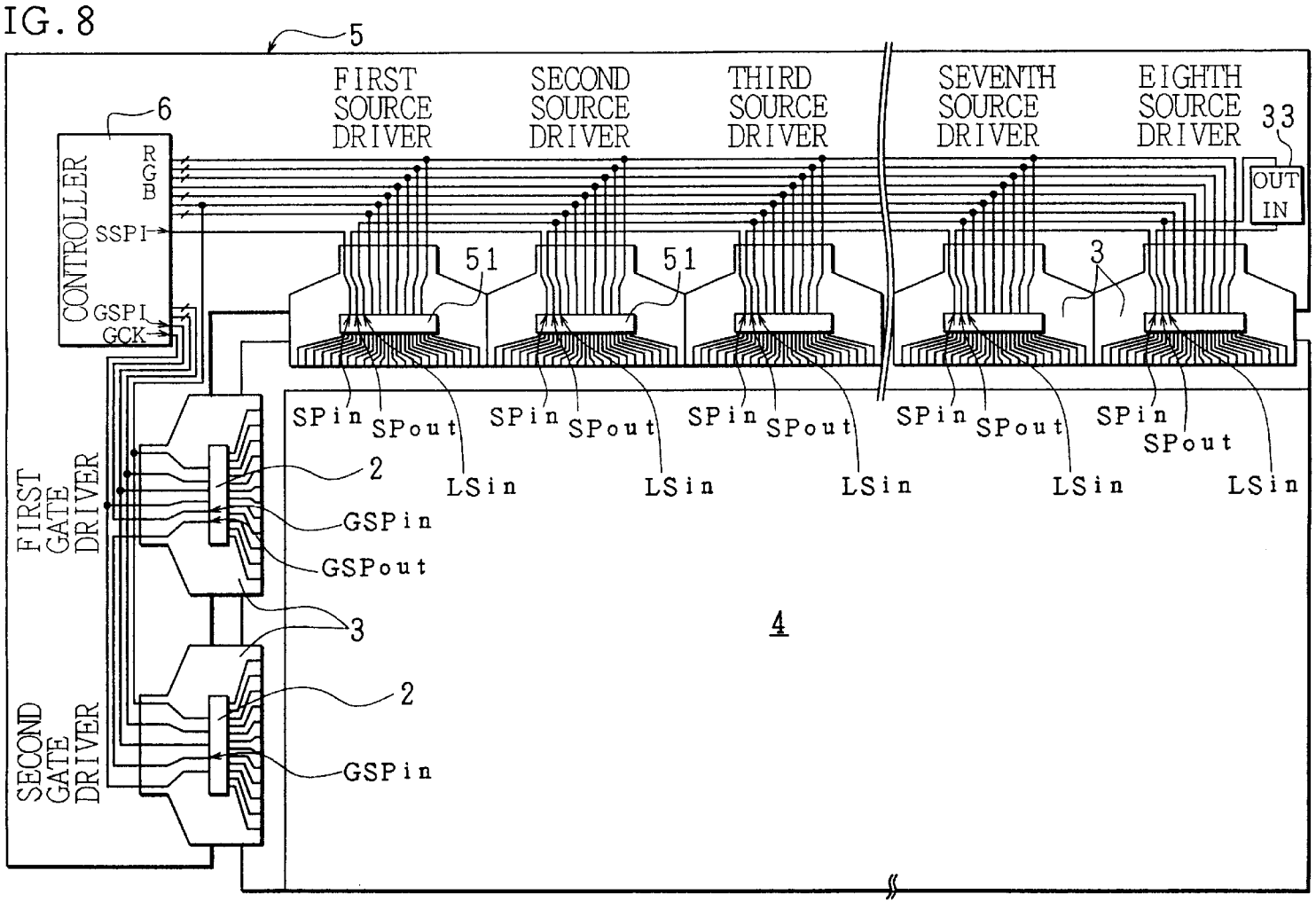
FIG. 8 is a plan view showing another embodiment of a liquid crystal module using a display drive device in accordance with the present invention.

Referring to FIG. 8, the following description will explain a further embodiment of the present invention. Here, for convenience, members of the present embodiment that have the same arrangement and function as members of the first embodiment, and that are mentioned in the first embodiment are indicated by the same reference numerals and description thereof is omitted.

The display drive device and the liquid crystal module of the present embodiment incorporates conventional source driver LSI chips 51, and still produce similar effects to the first embodiment, by mounting a delay circuit 33 on the flexible substrate 5.

In the display drive device of the present embodiment, the output terminal SPout of the eighth source driver is electrically connected to an input terminal IN of the delay circuit 33, and an output terminal OUT of the delay circuit 33 is electrically connected to the input terminals LSin of the first to eighth source drivers.

The delay circuit 33 may be composed of an even number of inverter circuits 24 connected in series as explained in the first embodiment. Alternatively, the delay circuit may be a delay circuit for effecting a delay by a CR time constant of a combined capacitor and resistor.

In the arrangement of the present embodiment, a display drive device of the present invention is realized using conventional source driver LSI chips 51 per se by modifying circuits on the flexible substrate 5 for providing common signals and a power supply. Therefore, the present embodiment produces effects similar to the first embodiment and those effects described below.

Manufacturing equipment needs only slight modification, which saves cost, since modifications should be made only on circuits on the flexible substrate 5 of the conventional display drive device, not on the source driver LSI chips 51. Further, more freedom is allowed in changing the design, since design changes may be done separately for the delay circuit 33 and for the source driver LSI chips 51.

Embodiment 4

Figure 9:
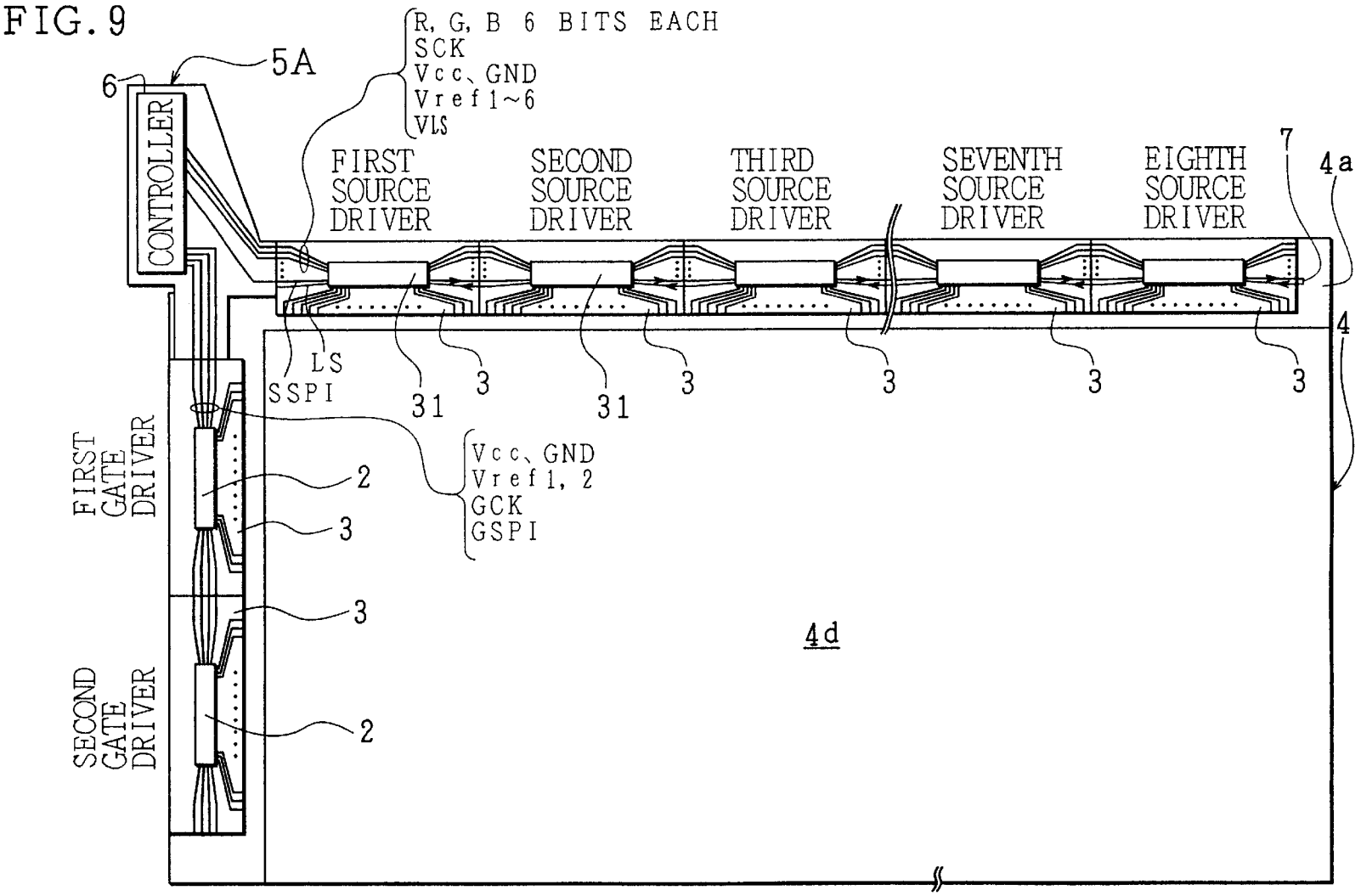
FIG. 9 is a plan view showing a further embodiment of a liquid crystal module using a display drive device in accordance with the present invention.

Referring to FIGS. 9 and 13, the following description will explain a further embodiment of the present invention. Here, for convenience, members of the present embodiment that have the same arrangement and function as members of the first embodiment, and that are mentioned in the first embodiment are indicated by the same reference numerals and description thereof is omitted.

In the liquid crystal module of the present embodiment, which is arranged as shown in FIG. 9 based on the liquid crystal module of the first embodiment, adjacent TCPs 3 are electrically connected, and internal wiring made of Al (Aluminum) lines is disposed in the source driver LSI chips 31 (will be mentioned later), so as to allow internal transmission of common signals and power supply associated voltages through the TCPs 3 and to dispense with the flexible substrate 5 for providing common signals and power supply associated voltages.

Figure 19:
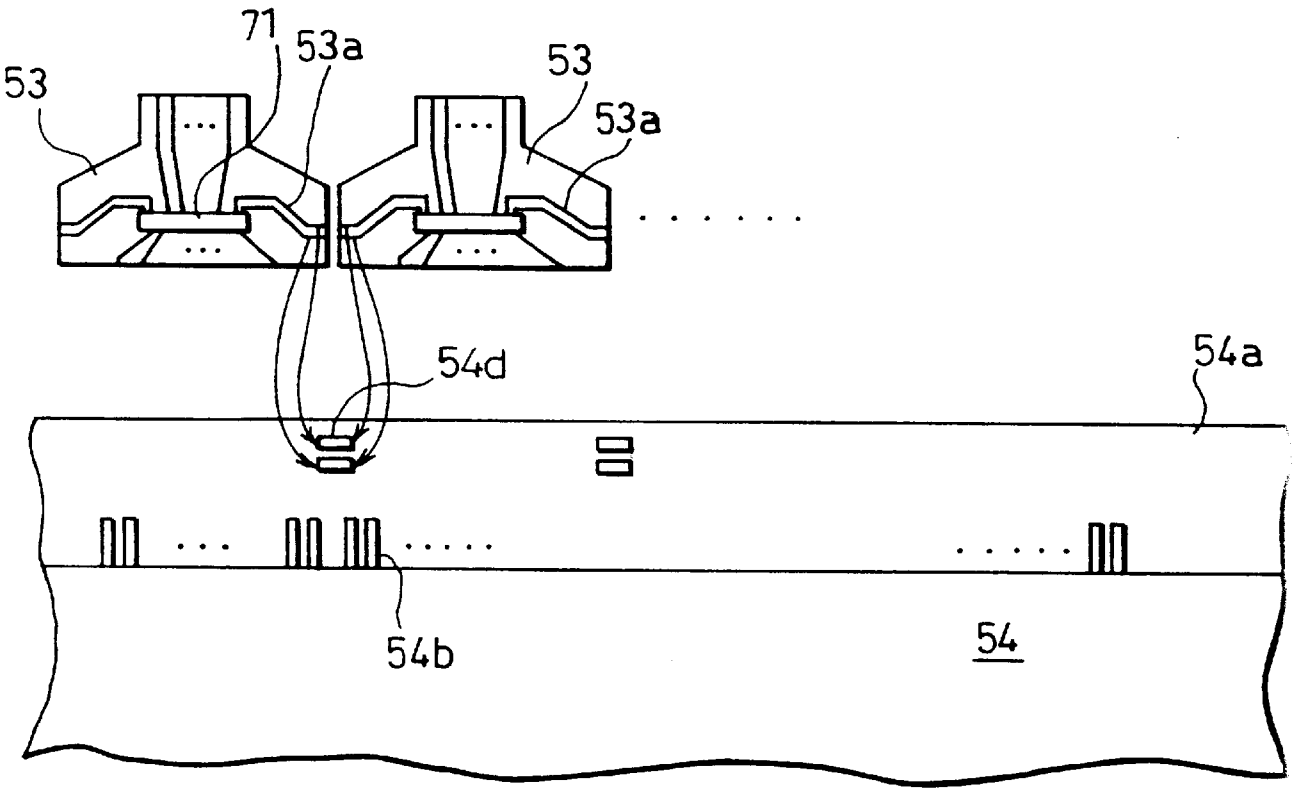
FIG. 19 PRIOR ART
FIG. 19 is a plan view showing connection between TCPs in the liquid crystal module.

The thirty signal and power supply associated lines disposed between adjacent source driver LSI chips 31 (6-bit R, 6bit G, 6-bit B, SCK, Vcc, GND, Vref1 to Vref6, VLS, SSPI, LS) are electrically connected to respective TCPs via the internal wiring of the source driver LSI chips 31, the TCP wiring on the TCPs 3, and the connection wiring (see FIG. 19) disposed on the liquid crystal panel 4 for electrically connecting the corresponding TCP wires on adjacent TCPs 3. The electrical connection between TCPs 3 is established similarly to FIG. 19 by disposing connection wiring made of the same ITO as terminals for pixels on the liquid crystal glass substrate 4*a*, which is a lower glass of the liquid crystal panel 4, and bonding the TCPs 3 to the liquid crystal glass substrate 4*a* via an ACF by thermocompression.

The output terminal SPDout and the input terminal LSin of the eighth source driver, however, are electrically connected via the TCP wiring on the TCPs 3, the connection wiring on the liquid crystal panel 4, and an ACF.

Further, the twenty-nine signal and power supply associated lines extending from the controller 6 mounted on the flexible substrate 5A are electrically connected via connection wiring on the liquid crystal panel 4 to the TCP 3 on which the first source driver is mounted, by bonding their respective predetermined terminals via an ACF to the connection wiring on the liquid crystal panel 4 by thermocompression similarly to the electrical connection between the TCPs 3.

Now, referring to FIG. 13, the following description will explain connection of between the liquid crystal panel 4 and the source driver LSI chip 31. Note that FIG. 13 shows a flexible substrate 5 in the far right which is unnecessary in the present embodiment.

The terminal 4*b* of the liquid crystal panel 4 is electrically connected, and fixed, to the TCP wiring of the TCP 3 via an ACF 4*c* by thermocompression bonding. The source driver LSI chip 31 is connected to a TCP wiring (inner lead section) via a bump. The TCP wiring is covered with solder resist for protection, except the foregoing connecting parts. Here, in FIG. 13, the sealing material providing protection to the source driver LSI chip 31 is omitted.

Figure 10:
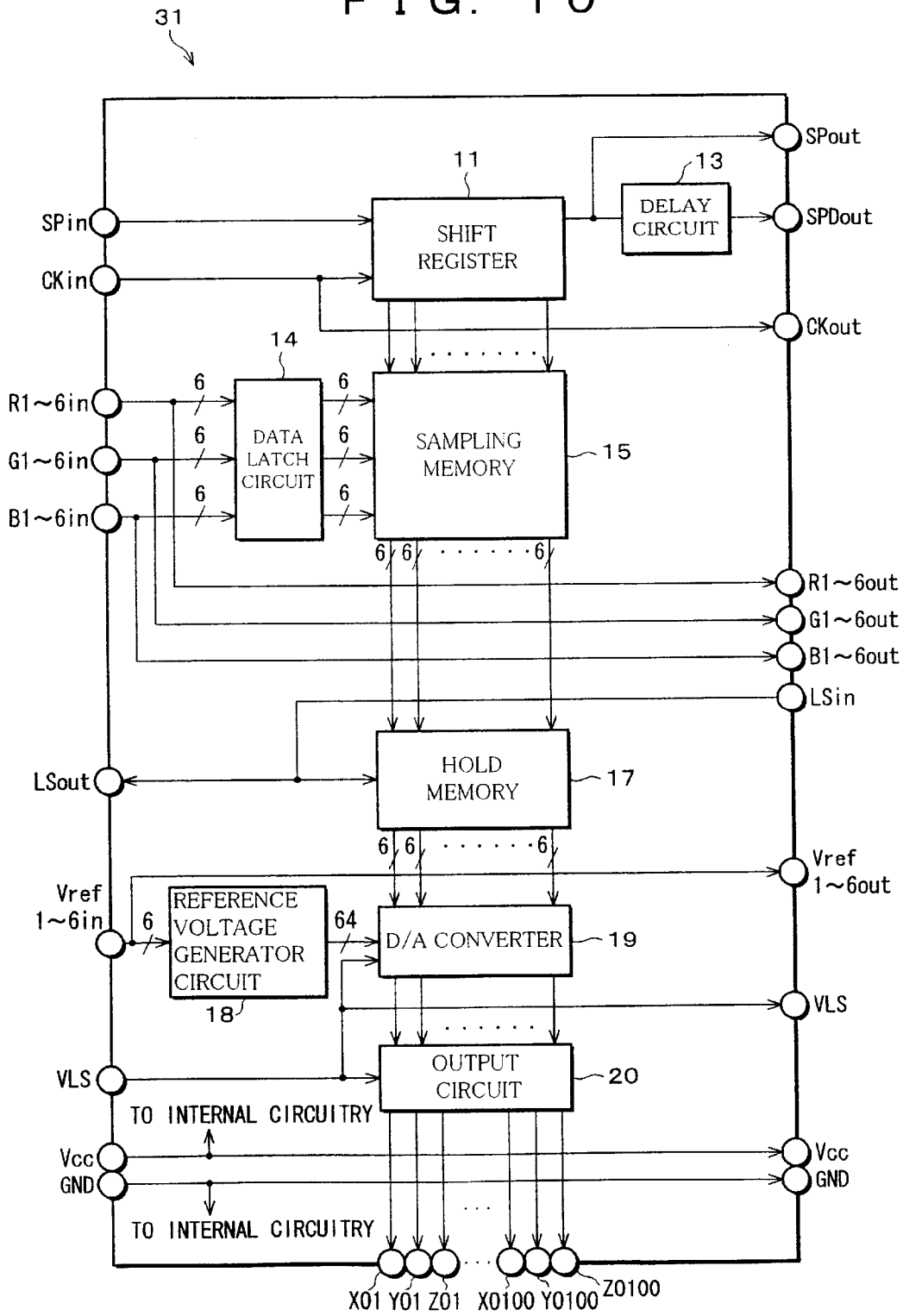
FIG. 10 is a block diagram showing an arrangement of a source driver LSI chip in the liquid crystal module.

Now, referring to a block diagram shown in FIG. 10, the following description will explain a circuit arrangement of the source driver LSI chip 31 used in the aforementioned display drive device.

As shown in FIG. 10, in the source driver LSI chip 31 which is arranged based on the source driver LSI chip 1, additional output terminals R1out to R6out, G1out to G6out, B1out to B6out, LSout, Vref1out to Vref6out, VLS, Vcc, and GND for providing common signals and power supply associated voltages are disposed and electrically connected via respective internal wires to the input terminals R1in to R6in, G1in to G6in, B1in to B6in, LSin, Vref1in to Vref6in, VLS, Vcc, and GND.

This allows internal transmission of the image data signals R, G, and B and the latch signal LS, which are common signals, and the half-tone display reference voltages Vref1 to Vref6, the brightness adjusting voltage VLS, the power supply voltage Vcc, and the ground potential GND, which are power supply associated voltages, through the source driver LSI chip 31.

That is, the common signals R, G, and B and the power supply associated voltages Vref1 to Vref6, VLS, Vcc, and GND provided by the controller 6 are, first, similarly to the arrangement of the first embodiment, coupled to the input terminals R1in to R6in, G1in to G6in, B1in to B6in, Vref1in to Vref6in, VLS, Vcc, and GND of the first source driver.

After being fed to the first source driver, the common signals R, G, and B and the power supply associated voltages Vref1 to Vref6, VLS, Vcc, and GND travel via the internal wiring and appear as outputs at the output terminals R1out to R6out, G1out to G6out, B1out to B6out, Vref1out to Vref6out, VLS, Vcc, and GND of the first source driver. The common signals R, G, and B and the power supply associated voltages Vref1 to Vref6, VLS, Vcc, and GND supplied by the first source driver are coupled to the respective input terminals R1in to R6in, G1in to G6in, B1in to B6in, Vref1in to Vref6in, VLS, Vcc, and GND of a next-stage, second source driver through the electrical connection between the adjacent TCPs 3.

Similarly, the common signals R, G, and B and the power supply associated voltages Vref1 to Vref6, VLS, Vcc, and GND are coupled to the respective input terminals R1in to R6in, G1in to G6in, B1in to B6in, Vref1in to Vref6in, VLS, Vcc, and GND of the third to eighth source drivers, as the signals are transmitted sequentially through the second to eighth source drivers.

The foregoing arrangement of the source driver LSI chip 31 of the present embodiment is identical to that of the conventional source driver LSI chip 71 shown in FIG. 18; however, the source driver LSI chip 31 differs from the source driver LSI chip 71 in that there is a delay circuit 13 disposed immediately downstream of the shift register 11 in the source driver LSI chip 31. The delay circuit 13 includes the arrangement explained earlier in the first embodiment.

Further, in the source driver LSI chip 31, there are disposed an output terminal SPout at which an outgoing start pulse signal SPO is provided at the same timing as in the conventional case and an output terminal SPDout at which an outgoing start pulse signal is provided at a timing delayed by a predetermined delay time by the disposition of the delay circuit 13.

In addition, in the present embodiment, the output terminal SPout of the first source driver is electrically connected to the input terminal SPin of the second source driver. Similarly to the foregoing, the output terminals SPout of the second to seventh source drivers are connected to the input terminals SPin of the third to eighth source drivers respectively. The output terminal SPDout of the eighth source driver is electrically connected to the input terminals LSin of the first to eighth source drivers.

The source driver LSI chip 31 additionally includes, unlike the source driver LSI chip 1, an output terminal LSout at which an outgoing latch signal LS is provided, and the output terminal LSout is electrically connected via wiring to the input terminal LSin. This allows internal transmission of the latch signal LS through the source driver LSI chip 31.

That is, first, similarly to the arrangement of the first embodiment, the latch signal LS, the common signals R, G, and B, and the power supply associated voltages Vref1 to Vref6, VLS, Vcc, and GND that are provided as outputs at the output terminals SPDout of the eighth source driver are coupled to the input terminal LSin of the eighth source driver.

Next, the latch signal LS coupled to the input terminal LSin of the eighth source driver travels via internal wiring, appears as an output at the output terminal LSout of the eighth source driver, and is coupled to the input terminal LSin of the seventh source driver via the electrical connection between the adjacent TCPs 3.

Similarly to the foregoing, the latch signal LS is further coupled to the input terminals LSin of the first to sixth source drivers, as the signal is transmitted sequentially through the seventh to first source drivers.

As shown schematically in FIG. 18, in the source driver LSI chip 31, the output terminals XO1 to XO100, YO1 to YO100, and ZO1 to ZO100 to the liquid crystal panel 4 are disposed along a side, whereas the input terminals SPin, CKin, R1in to R6in, G1in to G6in, B1in to B6in, Vref1in to Vref6in, VLS, Vcc, and GND and the output terminal LSout are disposed along one of the two sides crossing that side, and the output terminals SPout, CKout, R1out to R6out, G1out to G6out, B1out to B6out, Vref1out to Vref6out, VLS, Vcc, and GND and the output terminal LSout are disposed along the other of the two sides. Here, input and output buffer circuits are omitted in FIG. 18.

As explained above, the present embodiment can dispense with the flexible substrate (or print substrate) for providing the common signals and the power supply associated voltages to the source driver LSI chips 1, by enabling the common signals and the power supply associated voltages to travel between adjacent TCPs 3 via the internal wiring of the source driver LSI chips 31 and the TCP wiring. This facilitates reduction in cost and size of the display drive device and the liquid crystal module.

In the present embodiment, the adjacent TCPs 3 are electrically connected using the connection wiring on the liquid crystal panel 4; alternatively, the adjacent TCPs 3 may be electrically connected by stacking the TCP wiring of adjacent TCPs 3. A method of connecting the TCP wiring of adjacent TCPs 3 by stacking the TCP wiring is disclosed in aforementioned Japanese Laid-Open Patent Application No. 6-3684/1994 filed by the same applicant as the present application.

Embodiment 5

Figure 11:
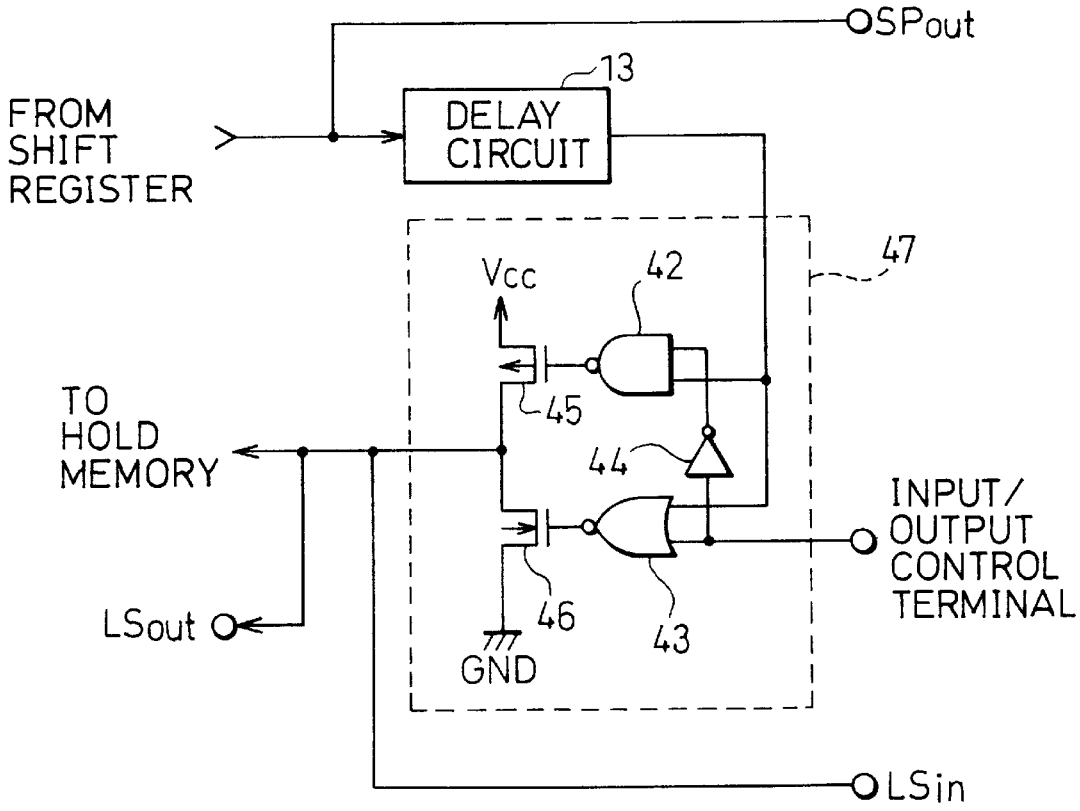
FIG. 11 is a block diagram showing a part, including a delay circuit and an input and output control circuit, of even another embodiment of the display drive device in accordance with the present invention.

Referring to FIG. 11, the following description will explain a further embodiment of the present invention. Here, for convenience, members of the present embodiment that have the same arrangement and function as members of the fourth embodiment, and that are mentioned in the fourth embodiment are indicated by the same reference numerals and description thereof is omitted.

As shown in FIG. 11, a display drive circuit of the present embodiment has an arrangement identical to that of the fourth embodiment, except that in the display drive circuit of the present embodiment, the output terminal SPDout is omitted by disposing an input and output control circuit (switching means) 47 immediately downstream of the delay circuit 13 in the source driver LSI chip 31 to control input and output.

The input and output control circuit 47 is composed of an NAND gate 42, an NOR gate 43, an inverter circuit 44, a P channel MOS (Metal Oxide Semiconductor) transistor 45, and an N channel MOS transistor 46, and is controlled by the signal supplied by an input and output control terminal.

The output terminal of the delay circuit 13 is connected to one of the input terminals of each of the NAND gate 42 and the NOR gate 43. The input and output control terminal is connected to the other input terminal of the NOR gate 43 and also to the input terminal of the inverter circuit 44. The output of the inverter circuit 44 is coupled to the NAND gate 42.

The output of the NAND gate 42 is coupled to the gate of the P channel MOS transistor 45, while the output of the NOR gate 43 is coupled to the gate of the N channel MOS transistor 46.

The source of the P channel MOS transistor 45 is connected to the terminal Vcc. Meanwhile, the drain of the P channel MOS transistor 45 is connected to the drain of the N channel MOS transistor 46, the input and output terminals LSin and LSout of the respective source driver LSI chips 1, and the hold memory 17. The source of the N channel MOS transistor 46 is grounded.

As to each of the first to seventh source drivers, the input and output control terminal is connected to the terminal Vcc outside the source driver LSI chip 31 to apply a power supply voltage Vcc to the input and output control terminal. This arrangement causes the P channel MOS transistor 45 and the N channel MOS transistor 46 to be in an off state and in a high impedance state. Consequently, the incoming signal provided via the input terminal LSin is given a passage.

Between adjacent source driver LSI chips 31, signals are transmitted from the output terminal SPout of the source driver LSI chip 31 in one stage to the input terminal SPin of the source driver LSI chip 31 in the following stage.

Meanwhile, as to the eighth source driver, the input and output control terminal is connected to the terminal GND to be at the ground potential GND. This arrangement enables the P channel MOS transistor 45 and the N channel MOS transistor 46 to operate, and causes the input terminal LSin to be in an open state. Therefore, the output of the delay circuit 13 is coupled to the hold memory 17 and the output terminal LSout.

Note that the input and output control terminal can be connected to either the terminal Vcc or the terminal GND by establishing connection of the terminal Vcc or the terminal GND via connection wiring on the liquid crystal panel 4, for example.

The output terminal SPDout can be omitted by controlling the input and output of a signal with the input and output control circuit (switching means) 47 as explained above. This arrangement enables the start pulse signal SPO and the latch signal LS to be internally transmitted through the source driver LSI chip 31, and eliminates the need for connection wiring on the liquid crystal panel 4 for connecting the output terminal SPDout of the eighth source driver to the input terminals LSin of the source driver LSI chips 31.

Embodiment 6

Figure 12:
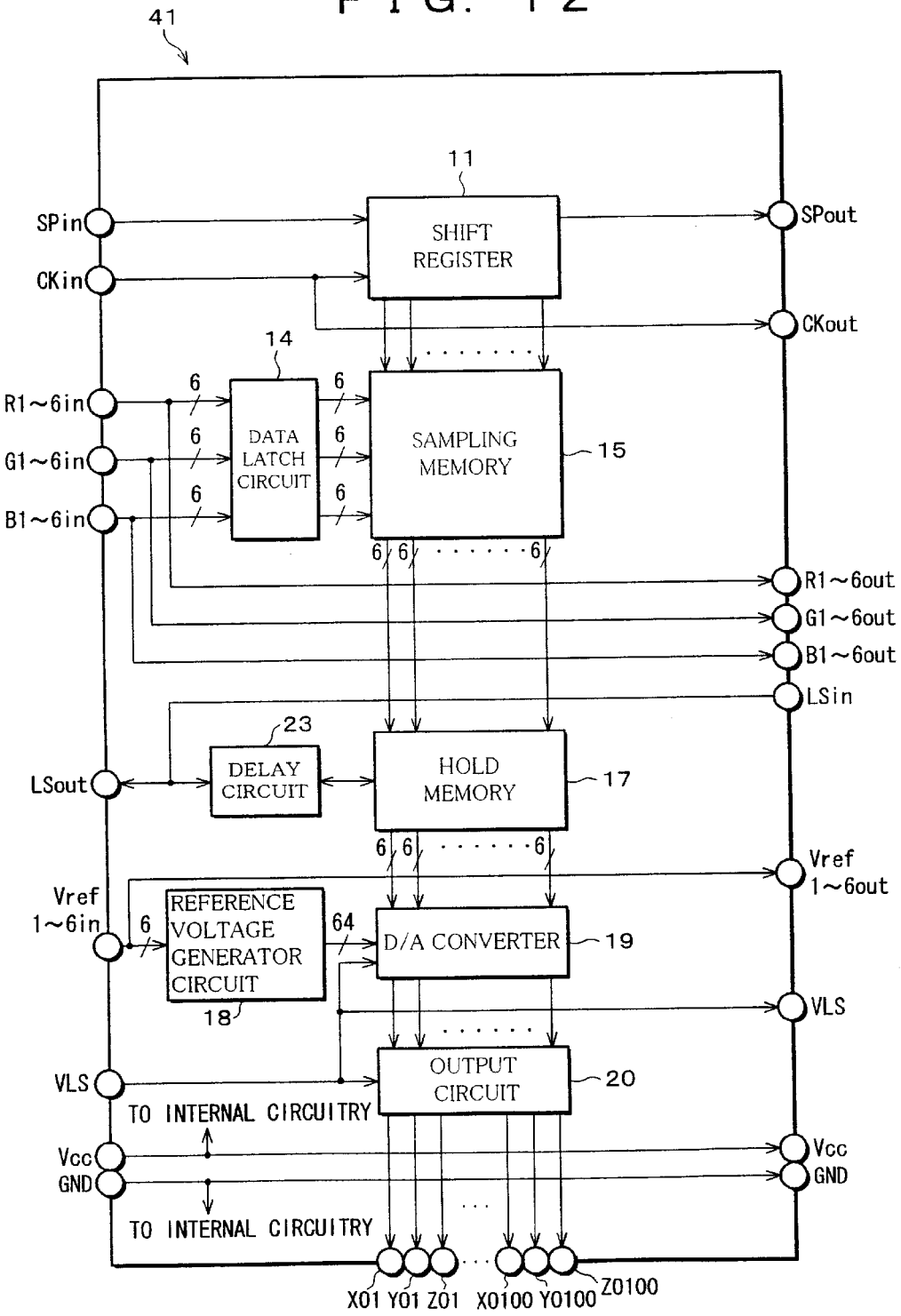
FIG. 12 is a block diagram showing an arrangement of a source driver LSI chip of still another embodiment of the display drive device in accordance with the present invention.

Referring to FIG. 12, the following description will explain a further embodiment of the present invention. Here, for convenience, members of the present embodiment that have the same arrangement and function as members of the first embodiment, and that are mentioned in the first embodiment are indicated by the same reference numerals and description thereof is omitted.

As shown in FIG. 12, the source driver LSI chip 41 of the present embodiment is identical to the source driver LSI chip 31 of the fourth embodiment, except that in the source driver LSI chip 41, the delay circuit 13 and the output terminal SPDout are omitted and a delay circuit 23 is interposed between the input terminal LSin and the hold memory 17. The delay circuit 23 is identical to the delay circuit 13 of the first embodiment.

The display drive device and the liquid crystal module (neither shown) of the present embodiment are identical to the display drive device and the liquid crystal module of the fourth embodiment, except that in those of the present embodiment, the source driver LSI chip 31 is displaced by a source driver LSI chip 41.

In the present embodiment, the latch signal LS shown in FIG. 4 is applied to the hold memory 17 at a delayed timing effected by the output of the delay circuit 23 in the source driver LSI chip 21.

The display drive device and the liquid crystal module in the present embodiment produce, similarly to those in the first embodiment, effects of adjusting and optimizing the timing of the latch signal LS and the image data signals R, G, and B in the source driver LSI chip 21, as well as the timing of the latch signal LS and the image data signals R, G, and B when mounted on the liquid crystal panel 4.

Here, in the source driver LSI chips 31 and 41 of the fourth to sixth embodiments, it is preferable to interpose a conventional input and output buffer circuit so as to switch, through the input and output control terminals, between inputs and outputs of the latch signals at two input and output terminals LSin/out, rather than to fix the latch signal output terminal to the terminal LSout and the latch signal input terminal to the terminal LSin.

With this arrangement, the source driver LSI chips 31 and 41 will find a wider range of application as they can be used for a liquid crystal module including a flexible substrate 5 for supplying common signals and power supply associated voltages, as exemplified in the first embodiment, simply by switching between the inputs and outputs at the input and output terminals LSin/out.

The foregoing description is given to explain the present invention by way of illustration only, since various changes and modifications within the spirit and scope of the invention will become apparent to those skilled in the art from this detailed description.

Accordingly, a change may be made in the fourth embodiment in which the controller 6 is mounted on a flexible substrate 5A, for example, so that the controller 6 is mounted on the liquid crystal panel 4 in the same manner as in the source driver LSI chip 31.

Besides, in the first to fourth embodiments, supposing that the delay circuit 13 effects only a minimal delay time, the output terminals SPDout of the first to seventh source drivers can be connected to the respective input terminals SPin of the following-stage source drivers (i.e., the second to eighth source drivers) without causing any problems. That is, the output terminal SPout may be omitted.

Further, in any of the foregoing embodiments, the output terminal SPDout may be omitted by disposing between the shift register 11 and the output terminal SPout a switch (switching means) for switching between the output signal of the delay circuit 13 and the output signal of the shift register 11 as the output signal at the output terminal SPout. In other words, the output terminal SPout may take over the function of the output terminal SPDout to omit the output terminal SPDout. This arrangement results in the source driver LSI chips 1 and 31 having less terminals.

Alternatively, as shown in FIG. 11, the delay circuit can be omitted by interposing a circuit including gates and/or MOS transistors between the output terminal SPout and the input terminal LS and effecting a delay using that circuit. In other words, the interposed circuit including gates and/or MOS transistors may be used as latch signal generator means.

Further, the number of pixels in the liquid crystal panel 4 is not limited to SVGA (800×RGB×600). The present invention is applicable to liquid crystal panels 4 having any number of pixels, including XGA, SXGA, and other systems.

In the foregoing description, liquid crystal drive devices used in liquid crystal modules were explained as examples; the display drive device of the present invention, however, is applicable not only to liquid crystal drive devices, but to any display drive device in which a plurality of drive circuits are cascade connected to transmit a start pulse signal in synchronization with a clock signal and effect a latch at a certain period. Exemplary applications include display drive devices included in plasma and other display devices.

Further, the display drive device of the present invention is applicable not only to liquid crystal drive devices, but to any source driver disposed in the X and Y directions in matrix type display devices to transmit a start pulse signal in synchronization with a clock signal, select an image signal in accordance with the start pulse signal in a time division manner, and carry out a display by effecting a latch on the start pulse signals in synchronization with a horizontal period.

As laid out so far, a display drive device in accordance with the present invention is a display drive device including a plurality of cascade connected drive circuits for driving a display element in accordance with an image data signal, each of the drive circuits including a shift register for shifting and transmitting a start pulse signal in synchronization with a clock signal; a selection circuit for selecting an image data signal in accordance with an output of the shift register; and a latch circuit for latching the selected image data signal in accordance with a latch signal, and is arranged so that a latch signal generator circuit for generating the latch signal in accordance with a start pulse signal supplied by the shift register in one of the drive circuits which is in a last stage is disposed.

The arrangement enables the display drive device to internally generate a latch signal, and can dispense with an external supply of a latch signal by a controller or the like. Therefore, the display drive device can dispense with circuits, in an external circuit, associated with the latch signal, output terminals of the external circuit, and latch signal transmitting wiring for electrically connecting the external circuit to the display drive device, which are all required with a conventional display drive device to supply a latch signal from the external circuit. The arrangement thereby enables the whole display drive device, including a controller, etc., to be produced in a smaller size and at a lower cost.

The latch signal generator means is preferably a delay circuit for generating the latch signal by delaying the start pulse signal supplied by the shift register in the last-stage drive circuit. When this is the case, the arrangement, since using a delay circuit for delaying the start pulse signal, is capable of generating a latch signal at a relatively low cost. Also, if the arrangement includes a delay circuit capable of adjusting the delay time, the latch signal becomes readily adjusted.

Here, the delay circuit is preferably capable of adjusting the delay time by means of metal option or laser cut.

The delay circuit is preferably disposed immediately downstream of the shift register in the last-stage drive circuit. When this is the case, since a single delay circuit can supply a latch signal to all the drive circuits, the disposition of the delay circuit causes increases in cost and device size only in a restrained manner.

Preferably, the delay circuit is disposed immediately downstream of the shift register in each of the drive circuits, and switching means for switching between input signals to the latch circuit so that either the output signal of the delay circuit or the externally received latch signal is selected as an input to the latch circuit is disposed immediately downstream of the delay circuit in each of the drive circuits.

When this is the case, the switching means causes the latch signal supplied by the last-stage drive circuit to be coupled to the latch circuit of the other drive circuits, as well as the latch signal supplied by the delay circuit in the last-stage drive circuit to be directly coupled to the latch circuit in the last-stage drive circuit without the latch signal travelling through an external path.

This arrangement permits the display drive device to dispense with external wiring for electrically connecting the output terminal at which a signal is provided for output by the delay circuit in the last-stage semiconductor device, to the input terminal at which a signal is received for input to the latch circuit in the last-stage semiconductor device. The display drive device thereby includes less wiring and can be produced in an even smaller size.

The delay circuit is preferably disposed immediately upstream of the latch circuit in each of the drive circuits. When this is the case, the start pulse signal per se supplied by the shift register can be used as the output from the last-stage drive circuit, as well as from the other drive circuits. Therefore, even if all the drive circuits share an identical arrangement, the disposition of the delay circuit can be prevented from increasing the number of terminals. Consequently, it becomes possible to offer display drive devices that can be manufactured at a high efficiency and a low cost.

As laid out above, a liquid crystal module in accordance with the present invention includes a display drive device having the earlier-mentioned arrangement and a liquid crystal display element as a display element driven by the display drive device. Since the display drive device is capable of internally generating a latch signal, the liquid crystal module does not need to supply a latch signal from an external circuit, such as a controller, disposed in the liquid crystal module. Therefore, the liquid crystal module can dispense with circuits, in an external circuit, associated with the latch signal, output terminals of the external circuit, and latch signal transmitting wiring for electrically connecting the external circuit to the display drive device, which are all required with a conventional liquid crystal module. The arrangement thereby enables the liquid crystal module to be produced in a smaller size and at a lower cost.

Note that each of the display drive devices of the foregoing arrangements is suitably used as a liquid crystal drive device for driving a liquid crystal panel or a like liquid crystal display element disposed in a liquid crystal display device, and is especially suitably used as a source driver, disposed in a matrix drive type liquid crystal display device, for supplying display data signals to a data line.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A display drive device including a plurality of cascade connected drive circuits for driving a display element in accordance with an image data signal, each of the drive circuits comprising a hold memory for latching a predetermined amount of the time division incoming image data signal in accordance with a latch signal, each of the drive circuits converting the latched image data signal to an analog signal and supplying the analog signal to the display element, wherein a latch signal generator circuit is provided in the drive circuit located in the last stage of the plurality of cascade connected drive circuits for generating the latch signal, wherein each of the drive circuits includes:

a shift register for shifting and transmitting a start pulse signal in synchronization with a clock signal;

a sampling memory for sampling and storing the time division incoming image data signal in accordance with an output signal of each stage of the shift register;

a hold memory for latching the predetermined amount of the image data signal in accordance with the latch signal; and an output circuit for converting the latched image data signal to an analog signal and supplying the analog signal to the display element, wherein the latch signal generator circuit provided in the last stage is a delay circuit that generates the latch signal based on the start pulse signal supplied by the drive circuit in the last stage.

2. The display drive device as set forth in claim 1, wherein the delay circuit delays the output of the shift register and supplies an output thereof as the latch signal to the hold memories of the other drive circuits.

3. The display drive device as set forth in claim 1, wherein the delay circuit includes an even number of inverter circuits connected with each other in series.

4. The display drive device as set forth in claim 3, further comprising at least one switch for short-circuiting even number of inverter circuits.

5. The display drive device as set forth in claim 1, wherein the delay circuit includes a capacitor and a resistor.

6. The display drive device as set forth in claim 5, wherein the delay circuit delays the output of the shift register and supplies an output thereof as the latch signal to the hold memories of the other drive circuits.

7. A display drive device including a plurality of cascade connected drive circuits for driving a display element in accordance with an image data signal, each of the drive circuits comprising a hold memory for latching a predetermined amount of the time division incoming image data signal in accordance with a latch signal, each of the drive circuits converting the latched image data signal to an analog signal and supplying the analog signal to the display element, said display drive device comprising:

a latch signal generator circuit for generating the latch signal according to a start pulse signal which has been transferred to a last stage of the plurality of cascade connected drive circuits, wherein the latch signal generator circuit is provided outside the drive circuit, wherein each of the drive circuits includes:

a shift register for shifting and transmitting a start pulse signal in synchronization with a clock signal;

wherein the latch signal generator circuit generates the latch signal according to the start pulse signal supplied by the drive circuit in the last stage;

wherein the latch signal generator circuit is a delay circuit for delaying the start pulse signal supplied by the drive circuit in the last stage.

8. The display drive device as set forth in claim 6, wherein the delay circuit is provided immediately downstream of the shift register in each of the drive circuits, and switching means, provided immediately downstream of the delay circuit in each of the drive circuits, for switching input signals to the hold memory so that either the output signal of the delay circuit or externally received latch signal is selected as an input to the latch circuit.

9. The display drive device as set forth in claim 8, the switching means including an NAND gate, an NOR gate, an inverter circuit, a P channel MOS transistor, and an N channel MOS transistor, wherein the output of the delay circuit is coupled to one of two input terminals of each of the NAND gate and the NOR gate, and an input and output control terminal through which a signal for switching the switching means is supplied is connected to the other input terminal of the NOR gate and an input terminal of the inverter circuit, wherein an output terminal of the NAND gate is connected to a gate of the P channel MOS transistor, an output terminal of the NOR gate is connected to a gate of the N channel MOS transistor, a source of the P channel MOS transistor is connected to an operation power supply, a drain of the P channel MOS transistor is connected to a drain of the N channel MOS transistor and the hold memory in each of the drive circuits, and a source of the N channel MOS transistor is grounded.

10. A display drive device including a plurality of cascade connected drive circuits for driving a display element in accordance with an image data signal, each of the drive circuits comprising:

a shift register for shifting and transmitting a start pulse signal in synchronization with a clock signal;

a selection circuit for selecting the image data signal in accordance with an output of the shift register; and a latch circuit for latching the selected image data signal in accordance with a latch signal, wherein a latch signal generator circuit for generating the latch signal in accordance with the start pulse signal supplied by the shift register is provided in the drive circuit located in the last stage of the plurality of cascade connected drive circuits, wherein the latch signal generator means is a delay circuit for delaying the start pulse signal supplied by the shift register in the last-stage drive circuit so as to generate the latch signal.

11. The display drive device as set forth in claim 10, wherein the delay circuit is provided immediately downstream of shift register in the last-stage drive circuit.

12. The display drive device as set forth in claim 11, wherein the delay circuit is provided immediately downstream of the shift register in each of the drive circuits, and switching means, provided immediately downstream of the delay circuit in each of the drive circuits, for switching input signals to the latch circuit so that either the output signal of the delay circuit or externally received latch signal is selected as an input to the latch circuit.

13. The display drive device as set forth in claim 10, wherein the delay circuit is provided immediately upstream of the latch circuit in each of the drive circuits.

14. A liquid crystal module, comprising:

a display drive device including a plurality of cascade connected drive circuits for driving a display element in accordance with an image data signal, each of the drive circuits comprising:

a shift register for shifting and transmitting a start pulse signal in synchronization with a clock signal;

a selection circuit for selecting the image data signal in accordance with an output of the shift register; and a latch circuit for latching the selected image data signal in accordance with a latch signal, wherein a latch signal generator circuit for generating the latch signal in accordance with the start pulse signal supplied by the shift register is provided in the drive circuit located in the last stage of the plurality of cascade connected drive circuits; and a liquid crystal display element driven by the display drive device, wherein the latch signal generator means is a delay circuit for delaying the start pulse signal supplied by the shift register in the last-stage drive circuit so as to generate the latch signal.

* * * * *